US010071842B2

(12) United States Patent
Jones et al.

(10) Patent No.: US 10,071,842 B2
(45) Date of Patent: Sep. 11, 2018

(54) APPARATUS, KIT AND METHOD OF ASSEMBLY OF A COLLAPSIBLE BULK MATERIAL CONTAINER

(71) Applicants: Robert J. Jones, Prior Lake, MN (US); Michael R. Jones, Apple Valley, MN (US)

(72) Inventors: Robert J. Jones, Prior Lake, MN (US); Michael R. Jones, Apple Valley, MN (US)

(73) Assignee: RMC Jones LLC, Prior Lake, MN (US)

( * ) Notice: Subject to any disclaimer, the term of this patent is extended or adjusted under 35 U.S.C. 154(b) by 0 days.

(21) Appl. No.: 15/394,147

(22) Filed: Dec. 29, 2016

(65) Prior Publication Data

US 2018/0186541 A1 Jul. 5, 2018

(51) Int. Cl.

| | |
|---|---|
| ***B65D 5/10*** | (2006.01) |
| ***B65D 5/56*** | (2006.01) |
| ***B65D 77/06*** | (2006.01) |
| ***B65D 5/42*** | (2006.01) |
| ***B65D 5/62*** | (2006.01) |
| ***B65D 5/44*** | (2006.01) |
| ***B65D 5/00*** | (2006.01) |
| ***B31B 7/26*** | (2006.01) |
| ***B31B 1/26*** | (2006.01) |
| ***B31B 1/60*** | (2006.01) |

(52) U.S. Cl.

CPC ..... *B65D 77/061* (2013.01); *B31B 1/26* (2013.01); *B31B 1/60* (2013.01); *B31B 7/26* (2013.01); *B65D 5/001* (2013.01); *B65D 5/10* (2013.01); *B65D 5/4266* (2013.01); *B65D 5/445* (2013.01); *B65D 5/56* (2013.01); *B65D 5/62* (2013.01); *B65D 77/062* (2013.01); *B31B 2201/26* (2013.01); *B31B 2201/6095* (2013.01); *B31B 2217/0038* (2013.01)

(58) Field of Classification Search

CPC ..... B65D 77/062; B65D 77/061; B65D 5/10; B65D 5/4266; B65D 5/563; B65D 5/001; B65D 5/445; B65D 5/56; B65D 5/62; B29C 65/08; B29C 66/1122; B29C 66/4322; B29C 66/729; B31B 1/26; B31B 1/60; B31B 7/26

USPC .. 229/108, 199, 122.33, 122.32, 164.1, 919, 229/920; 206/410

See application file for complete search history.

(56) References Cited

U.S. PATENT DOCUMENTS

| | | | |
|---|---|---|---|
| 49,390 | A | 8/1865 | Doolittle |
| 915,455 | A | 3/1909 | Lynch, Jr. |
| 920,637 | A | 5/1909 | Paar |

(Continued)

*Primary Examiner* — Christopher Demeree

(74) *Attorney, Agent, or Firm* — Merchant & Gould P.C.

(57) ABSTRACT

A collapsible bulk material container apparatus, kit and method of assembly employ a forming member having a plurality of interconnected sidewalls, a locking mechanism that fixedly orients the sidewalls continuously about an internal bulk material receiving cavity, and a tubular open-ended woven fabric sleeve that supportively overlies the sidewalls. A connector system rapidly engageable during container assembly, fixedly secures the support sleeve of an unloaded container against subsequent upward movement along the sidewalls. Strategically located friction reducing surfaces of the forming member facilitates sliding assembly of the sleeve over the forming member sidewalls.

20 Claims, 18 Drawing Sheets

(56) References Cited

U.S. PATENT DOCUMENTS

| | | | | |
|---|---|---|---|---|
| 1,044,023 | A | 11/1912 | Colgate | |
| 1,139,281 | A | 5/1915 | Hazelton | |
| 1,794,821 | A | 3/1931 | Andrews | |
| 2,056,956 | A | 10/1936 | Carpenter | |
| 2,337,370 | A | 12/1943 | Broadfoot | |
| 2,502,586 | A | 4/1950 | Ottinger | |
| 2,611,526 | A | 9/1952 | George | |
| 3,123,254 | A | 3/1964 | Rabby et al. | |
| 3,257,068 | A | 6/1966 | Wright | |
| 3,423,009 | A | 1/1969 | Palmer | |
| 3,653,578 | A | 4/1972 | Wood | |
| 3,779,448 | A | 12/1973 | Wootten | |
| RE28,439 | E | 6/1975 | Shepherd | |
| 3,896,991 | A | 7/1975 | Kozlowski et al. | |
| 3,937,392 | A | 2/1976 | Swisher | |
| 3,945,493 | A | 3/1976 | Cardinal | |
| 3,957,195 | A | 5/1976 | Lin | |
| 3,983,914 | A | 10/1976 | Benson | |
| 4,013,168 | A | 3/1977 | Bamburg et al. | |
| 4,115,909 | A | 9/1978 | Corella | |
| 4,176,748 | A | 12/1979 | Beane | |
| 4,226,327 | A | 10/1980 | Ballard | |
| 4,308,905 | A | 1/1982 | Gallagher | |
| 4,337,888 | A | 7/1982 | Kudalkar | |
| 4,362,199 | A | 12/1982 | Futerman | |
| RE31,191 | E | 3/1983 | Connolly | |
| 4,457,483 | A | 7/1984 | Gagne | |
| 4,538,385 | A | 9/1985 | Kandarian | |
| 4,622,693 | A | 11/1986 | Mykleby | |
| 4,655,366 | A | 4/1987 | Sykes | |
| 4,666,059 | A | 5/1987 | Nordstrom | |
| 4,850,506 | A | 7/1989 | Heaps, Jr. et al. | |
| 4,868,955 | A | 9/1989 | Magnant et al. | |
| 4,903,431 | A | 2/1990 | Stoll | |
| 4,997,125 | A | 3/1991 | Glerum | |
| 5,158,369 | A | 10/1992 | Derby | |
| 5,165,568 | A | 11/1992 | Wischusen, III | |
| 5,226,544 | A | 7/1993 | Gallucci et al. | |
| 5,285,957 | A | 2/1994 | Halsell | |
| 5,323,922 | A * | 6/1994 | Lapoint, Jr. ..... | B65D 88/1625 220/4.28 |
| 5,340,217 | A | 8/1994 | Rothman | |
| 5,405,006 | A | 4/1995 | Burgdorf et al. | |
| 5,518,168 | A | 5/1996 | Mayer | |
| 5,566,531 | A | 10/1996 | Nordstrom et al. | |
| 5,758,973 | A | 6/1998 | LaFleur | |
| 5,759,644 | A | 6/1998 | Stanley | |
| 5,772,108 | A | 6/1998 | Ruggiere, Sr. et al. | |
| 5,795,282 | A * | 8/1998 | deMunnik ..... | B65D 5/62 112/475.06 |
| 6,431,435 | B1 | 8/2002 | Jones et al. | |
| 6,932,266 | B2 | 8/2005 | Jones et al. | |
| 8,814,031 | B2 * | 8/2014 | Graham ..... | B65D 5/12 229/108.1 |
| 8,978,964 | B1 * | 3/2015 | Ruggiere, Sr. ..... | B65D 5/445 229/164.1 |
| 2006/0027638 | A1 * | 2/2006 | Jones ..... | B65D 5/029 229/117.35 |

* cited by examiner

APPARATUS, KIT AND METHOD OF ASSEMBLY OF A COLLAPSIBLE BULK MATERIAL CONTAINER

FIELD OF THE INVENTION

This invention relates generally to shipping and storage containers for bulk liquid and granular materials, that are collapsible and/or reusable or recyclable. More particularly, the invention relates to bulk material handling containers of the type generally shown and described in U.S. Pat. No. 6,932,266 entitled COLLAPSIBLE BULK MATERIAL CONTAINER, issued on Aug. 23, 2005 and fully incorporated herein by reference.

BACKGROUND OF THE INVENTION

A general description of known configurations of bulk material containers is detailed in the Background section of the U.S. Pat. No. 6,932,266. The U.S. Pat. No. 6,932,266 also describes a number of embodiments of improved bulk material container configurations to which the present invention is specifically directed.

Several of the container embodiments described in the U.S. Pat. No. 6,932,266 and shown in FIGS. 1, 8 and 9 of the U.S. Pat. No. 6,932,266 have been renumbered and are illustrated herein as FIGS. 1, 2 and 3 respectively. Referring thereto, a bulk material container 10 generally includes a forming member 12, a locking mechanism 12*a*, an outer sleeve 14 and optionally an inner liner 16. The forming member 12 is typically constructed of relatively inexpensive lightweight corrugated material that can be operatively configured to define an internal geometric volumetric shape that defines the bulk material storage portion of the container 10. The forming member and locking assembly are collapsible for storage and transport before use and are easily unfolded and shaped to form an operable box-like container configuration as shown in FIG. 1, and also provide structural support for enabling stacking of loaded/filled containers.

The forming member 12 has a plurality of interconnected sidewalls 12*b* that are configurable to form a closed perimeter of the internal geometric volume. The bottom edges 17 of the sidewalls 12*b* are designed to be supported on and carried by a pallet. A locking assembly maintains the forming member sidewalls in predetermined fixed position relative to one another when the container is empty. While the locking mechanism can be physically separable from the sidewalls, in the embodiments shown in FIGS. 1-3, the locking assembly comprises lower extension portions 12*a* of the sidewalls 12*b* that fold inwardly along the bottom edges 17 of the sidewalls and overlap with one another to form a bottom surface of the container and of the internal geometric volume. At least some of the inwardly folded sidewall extensions 12*a* have slots generally shown at 18 for cooperatively receiving and interconnecting with edges or other portions of the sidewall extensions that are folded forming a locking assembly of the sidewall extensions. The locking assembly initially maintains the sidewalls in predetermined fixed relationship to one another around the defined internal volume when operatively assembled, and prevents the sidewalls 12*b* from riding or sliding upward in a direction away from the bottom of the forming member during filling of the container.

As described in the U.S. Pat. No. 6,932,266, an optional bag/liner illustrated at 16 in FIG. 1 may be inserted within the internal geometric volumetric shape of the forming member to accommodate the particular bulk material with which the container will be used. The bag/liner 16 may for example, protect the contents of the container system and/or prevent leakage of liquids or sifting of powders out of the forming member. Such bags/liners are well-known in the art and described in more detail in the U.S. Pat. No. 6,932,266.

The sleeve member 14 is sized to cooperatively and snugly engage and circumferentially surround substantially the entire outer peripheral sidewall portions 12*b* of the forming member 12. The sleeve 14 is preferably configured in a continuous manner from a flexible, woven fiber material known for its strength and light weight. The sleeve is sized to extend down to and beyond the lower edges 17 of the sidewalls 12*b*. In the container embodiment illustrated in FIG. 1, the lower portion of the sleeve 14 that extends beyond the lower edges 17 of the sidewalls 12*b* is folded back up along the sidewalls, as shown at 15, to provide additional strength along the lower portions of the sidewalls.

In the container illustrated in FIGS. 2 and 3, those portions of the sleeve 14 that extend beyond the lower edges 17 of the sidewalls 12*b* are folded inwardly under the lower edges 17 of the sidewalls 12*b* and engage the lower surfaces of the sidewall extension portions 12*a* forming the locking assembly and the bottom of the container. The sidewall extension members interlock with one another by means of the angled slot configurations generally shown at 18. Referring to the container embodiment shown in FIGS. 2 and 3, it can be observed that when the lower extension members 12*a* are operatively folded to form the container bottom and locking assembly, portions of the extension members 12*a* horizontally overlap one another forming several vertical gaps or void areas G between overlapping surfaces of the extensions 12*a*. As the sleeve 14 is folded under the lower edges 17 of the sidewalls 12*b*, excess sleeve material gathers under the bottom of the container adjacent the corners of the forming member. The excess sleeve material is typically tucked into the gaps or void areas G as illustrated at 19*a*. As described in the U.S. Pat. No. 6,932,266, tucking the excess sleeve material under the forming member and into the gaps G helps to counteract undesired upward sliding movement of the sleeve 14 along the sidewalls 12*b* as outward pressure is exerted on the forming member and sleeve as bulk material is loaded into the container. As the weight of bulk material loaded into the container increases, downward pressure exerted by the material on the lower extension members 12*a* of the forming member vertically compresses the sleeve material in the gaps G between the overlapping extension members 12*a*, tightly sandwiching and holding the sleeve member therebetween as the pressure increases.

Bulk material container assemblies of the type generally described above have been well received in the market place and have been used by a wide variety of customers for a wide range of different bulk materials. Such diversified use has uncovered aspects of embodiments, configurations and features of the bulk material container assemblies that can be improved upon to enable customized response to customer and content diversity and the market place competitive environment.

One such area for improvement relates to maintaining the overlying sleeve in optimal operative position overlying the forming member during handling and use of the container. In theory, the tucked in sleeve material design described above works well if reasonably careful handling of the container is maintained between its assembly stage and its placement and positioning on a pallet prior to loading the container. However, it has been found that operators assembling the containers are prone to tossing assembled containers onto the pallets and to sliding them across the pallet surfaces when positioning or "squaring-up" the container on the pallet for loading. In doing so, such jarring and sliding movement can cause the previously tucked in lower sleeve material 19*a* to be jarred or dislodged from and out of its tucked in position in the gaps or void areas G formed between the extension members 12*a*. Once dislodged from their tucked in positions, the loose sleeve end portions simply rest on the pallet surface and potentially in a manner that protrudes outside of the container's footprint, thereby potentially enabling the sleeve 14 to slide upwardly along the forming member sidewalls 12*b* during loading of bulk material into the container and during subsequent handling and shipment, potentially decreasing the effectiveness of the sleeve to reinforce the forming member in its intended manner. The present invention addresses this issue.

Another area addressed by the invention relates to a modification of the forming member that facilitates assembly of the container, and in particular of the process of sliding the sleeve into the desired operative position overlying the forming member.

SUMMARY OF THE INVENTION

This invention uses existing industry accepted packaging materials to form a unique bulk container system that is universally applicable to the packaging of solid, semi-solid, granular or liquid materials. The bulk container system of this invention comprises the advantageous features of known packaging techniques in an unique manner without suffering their respective short comings. A forming member of relatively inexpensive lightweight corrugated material has a plurality of interconnected sidewalls that define an internal geometric volume metric shape of the container in a manner that provides shape to the container and structural support for enabling stacking of loaded/filled containers. A locking assembly operatively connected with the forming member, holds and locks the forming member sidewalls in predetermined operative positions relative to one another, to define a desired geometric volume and shape. The locking assembly may comprise an extension of the forming member and may form a bottom of the container when operatively assembled. The forming member and locking assembly are collectively collapsible for storage and transport and are easily erected by folding to an operable box-like container configuration. The assembled bulk container system is designed to be placed on and carried by a pallet.

An outer tubular sleeve, that can be configured without stitching or seams, is sized to surround and snuggly engage substantially the entire outer peripheral walls areas of the forming member, and assumes the defined geometric shape of the outer surface of the forming member. The outer sleeve is preferably of woven polypropylene material and provides the necessary strength for containing the bulk material within the forming member, while the forming member provides the desired rigidity and shape to the bulk material container system. A standard bag/liner can be and typically is placed within the forming member to protect the bulk contents from contamination or environment, and/or to retain liquids or flowable bulk materials. The bulk containers system includes a unique securement system for maintaining the outer sleeve in a fixed position relative to the forming member. The forming member is also configured to facilitate sliding of the outer sleeve into operative position overlying the forming member.

According to one aspect of the invention, there is provided a container for bulk materials, comprising: (a) a forming member comprising a plurality of foldably interconnected sidewalls extending between upper and lower edges and operative when folded to cooperatively form and encircle an internal cavity for receiving bulk materials; (b) a locking assembly cooperatively engaging the sidewalls to define and fix the sidewalls in predetermined relative positions with the locking assembly forming at least in part a bottom surface of the cavity; (c) an outer sleeve with opposed open ends, made of continuous woven material and sized, arranged, and configured to snugly engage and overlie substantially the entire outer surfaces of the sidewalls and to extend below the lower edges of the sidewalls; (d) wherein the lower extended portion of the sleeve is folded inwardly along the sidewall lower edges toward the internal cavity and in underlying engagement with the locking assembly; and (e) cooperatively couplable fasteners on the outer sleeve and the locking assembly, operative when coupled to one another to secure the inwardly folded portion of the sleeve to the locking assembly to prevent the sleeve from upward sliding movement along the sidewalls.

According to a further aspect of the invention, the forming member and the locking assembly comprise a single piece of material that may be corrugated material as, for example, corrugated cardboard material. According to yet another aspect of the invention, the couplable fasteners comprise a first pair of fasteners on the locking assembly, and a second pair of fasteners on the sleeve, that are operatively aligned and engageable with the first pair of fasteners; and wherein the first and second pair of fasteners when coupled to one another pull the sleeve material taut between the first pair of fasteners and against the locking assembly. According to yet a further aspect of the invention, the cooperatively couplable fasteners of the locking assembly comprise a pair of opposed spaced tabs, and wherein the cooperatively couplable fasteners of the sleeve comprise a pair of slots formed through the sleeve material arranged and configured to operatively and retainably align and couple with the tabs of the locking assembly.

According to a further aspect of the invention, the tab fasteners may include a first outwardly projecting arcuate edge portion configured to cooperatively engageably slide through the slot fasteners of the sleeve. Further, the fastener tabs may include a second edge portion continuously extending from the first edge portion and defined by a slit formed through the locking assembly material. According to yet a further aspect of the invention, the tab connectors may include a third edge portion characterized by a hook configuration extending from the slit forming the second edge portion of the tabs.

According to yet a further aspect of the invention, the sleeve can be operatively positioned overlying the forming member by sliding the sleeve over the forming member sidewalls from either their upper or lower edges. The sleeve preferably is slid onto the forming member when the forming member is in a collapsed folded configuration. According to yet a further aspect of the invention, the sidewall edge over which the sleeve is slid, may contain cutout portions formed along the outer ends of the edge over which the sleeve is slid, to reduce friction and catching of the sleeve material on the sidewall edge during the sliding operation.

According to yet a further aspect of the invention, there is provided a bulk material container kit, comprising: (a) a collapsible forming member comprising a plurality of interconnected sidewalls extending between upper and lower edges and foldable to cooperatively form an outer peripheral sidewall structure that encircles an internal cavity for receiving bulk materials; (b) a collapsible locking assembly cooperatively engageable with the forming member sidewalls to define and fix predetermined relative positions of the sidewalls, and to form at least in part a bottom surface of the internal cavity; (c) an outer sleeve with opposed open ends, comprising continuous woven material that is sized, arranged and configured to snugly engage and overlie substantially the entire outer surfaces of the sidewalls and to extend below the lower edges of the sidewalls for folding inwardly along the lower edges, in a direction toward the internal cavity, and for underlying engagement with the locking assembly; and (d) cooperatively couplable fasteners on the outer sleeve and the locking assembly, of a type that when operatively coupled can secure inwardly folded portions of the sleeve to the locking assembly to prevent the sleeve from moving upward along the sidewalls.

According to yet a further aspect of the invention, the forming member and locking assembly portions of the bulk material container kit comprise a single piece of material. According to yet a further aspect of the invention, the cooperatively couplable fasteners of the bulk material container kit may comprise a first set of opposed spaced fasteners on the locking assembly and a second set of fasteners comprising slots formed through the inwardly foldable portion of sleeve material, that are arranged, sized, and configured to cooperatively retainably engage the first set of fasteners.

According to yet a further aspect of the invention, there is provided a method of assembling a bulk material container comprising the steps of: (a) procuring a forming member for the container of a type comprising a collapsible foldable plurality of connected sidewalls extending between upper and lower edges; (b) procuring a foldable locking assembly for fixedly positioning the sidewalls of the forming member, which may comprise a part of or be pre-connected with the forming member, and which includes a plurality of spaced connector tabs; (c) procuring an outer support sleeve member of continuous woven material extending between opposed open ends, sized and configured to snugly cooperatively engage and overlie the sidewalls of the forming member and having a length between its ends greater than that of the sidewalls, and having a plurality of circumferentially spaced slots formed through the sleeve material adjacent one end thereof; (d) configuring the outer sleeve over the forming member sidewalls so as to overlie substantially the total outer surface area of the sidewalls and to extend below the lower edge of the sidewalls such that the end of the sleeve having the slots extends below the lower edge of the sidewalls and in operative alignment with the connector tabs of the locking assembly; (e) configuring the forming member with its upper sidewall edges supportively resting on a generally planar surface such that the sidewalls enclose an internal cavity configured to receive bulk material; (f) securing the locking assembly relative to the forming member to fixedly lock the forming member sidewalls in operative positions relative to one another about the internal cavity; (g) folding the sleeve end having the spaced slots inwardly over the locking assembly; and (h) engaging the sleeve slots to the locking assembly connector tabs to secure the sleeve to the locking assembly. According to another aspect of the invention, the method of assembling the bulk material container comprises securing the sleeve slots and connector tabs in a manner such that the secured sleeve material is pulled taut between opposed spaced connector tabs, and against the locking assembly. According to yet a further aspect of the invention, the method of assembling the bulk material container further includes a step of tucking in excess unsecured portions of the folded sleeve material into sleeve receptor receptacles of the locking assembly.

These and other features of the invention will become apparent upon a more detailed description of a preferred embodiment of the invention, as described below.

BRIEF DESCRIPTION OF THE DRAWING

Referring to the Drawing, wherein like numerals represent like parts throughout the several views.

DETAILED DESCRIPTION OF THE INVENTION

One embodiment of a bulk material container assembly incorporating the principles of this invention will be described below with reference to FIGS. 4-17. Descriptions of alternative bulk material container embodiments, of their use and construction, of the materials that are usable to construct the container assembly, and other alternatives applicable to the invention are described more fully in U.S. Pat. No. 6,932,266 which is fully incorporated herein by reference.

Figure 4:
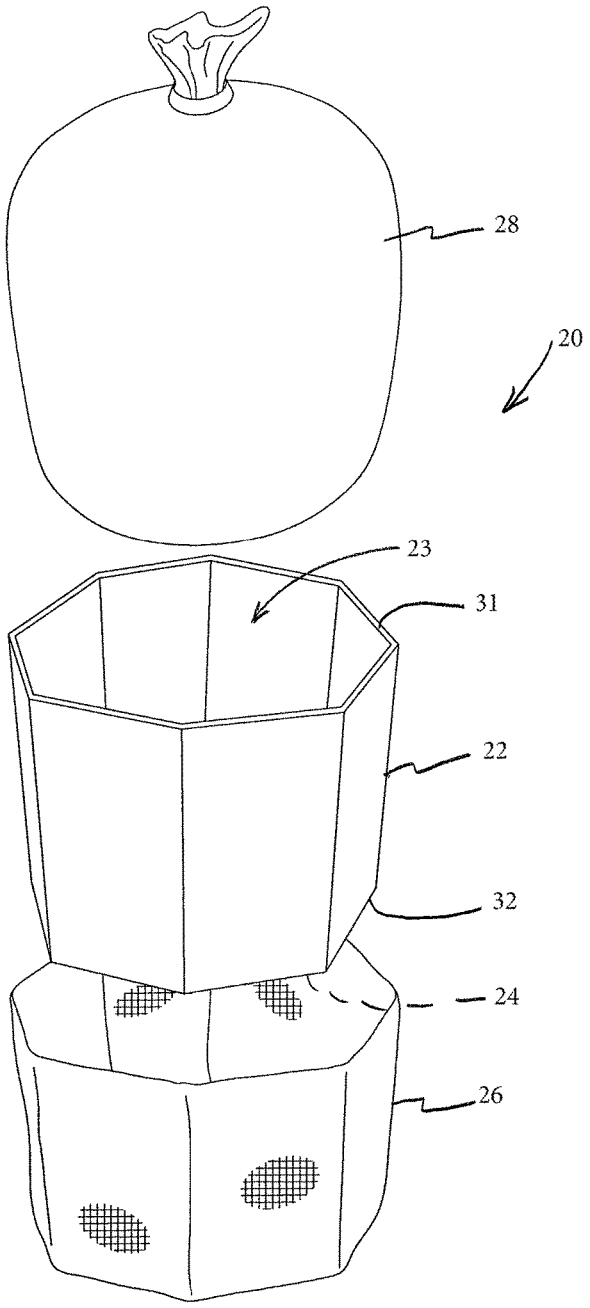
FIG. 4 is an exploded perspective view of one embodiment of a bulk material container assembly configured according to this invention, having a forming member with a shape defining locking assembly, an outer sleeve member and an optional bag/liner.

Referring to FIG. 4, a bulk material container assembly is generally illustrated at 20. For ease of description, the bulk material container assembly will hereinafter be referred to as "the container". The container 20 generally includes a forming member 22, a locking assembly or mechanism 24, an outer support sleeve 26 and an optional inner liner 28. The forming member 22 provides a defined geometric shape and structural stability to the container, while the sleeve 26 is sized to cooperatively and snuggly engage and circumferentially surround at least substantially the entire outer surface area of the forming member sidewalls 22 and provides the primary bulk material containment strength for the container. The optional inner bag/liner 28 is generally placed within the forming member 22 and directly contacts the bulk material, to protect the container contents from contamination and/or to retain flowable or liquid contents from leaving or leaking out of the container.

The forming member 22 is preferably configured from a relatively light-weight corrugated material which can, for example, be either of cellulose or plastic construction. When collapsed for shipment to a user, the forming member can be configured as a single planar sheet (FIG. 5), or, depending upon the particular construction, folded over onto itself in a collapsed manner (FIGS. 9 and 10). The forming member is folded along a plurality of fold lines, shown as dashed lines 30, 32 in FIG. 5 to form a plurality of adjoining upright sidewalls configured to form a closed perimeter shell as shown in FIG. 4. Closed perimeter forming member sidewalls define with a lower surface, an internal geometric 23 volumetric shape that defines the bulk material storage portion of the container. The bottom edges 32 of the forming member sidewalls are designed to be supported and carried by a pallet. While a pallet can contain more than one of the containers, typically the container is sized and configured to be carried by a single pallet. The locking mechanism maintains the forming member sidewalls in predetermined upright fixed position relative to one another when the container is empty. While the locking mechanism can be physically separable from the sidewalls, in the embodiment illustrated FIGS. 4-17, the locking mechanism or assembly comprises lower extension portions of the forming member's sidewalls, generally illustrated at 24 in FIG. 5. The lower extension locking portions 24 of the sidewalls fold inwardly along the bottom edges 32 of the sidewalls and overlap and interconnect with one another to fix and maintain the forming member sidewalls in predetermined spaceal relationship with one another when operatively assembled, hereinafter described, around the defined internal geometric volumetric shape 23. The interlocking lower locking assembly portions 24, when operatively assembled, also form and define a bottom surface of the container. Besides fixing the geometric footprint formed by the sidewalls, the locking assembly also prevents the sidewalls from riding or sliding upwardly, away from the bottom of the forming member during filling or transporting of the container. For additional details, description of materials and design considerations relating to bulk material containers of the general type described herein, the reader is referred to U.S. Pat. No. 6,932,266.

Figure 5:
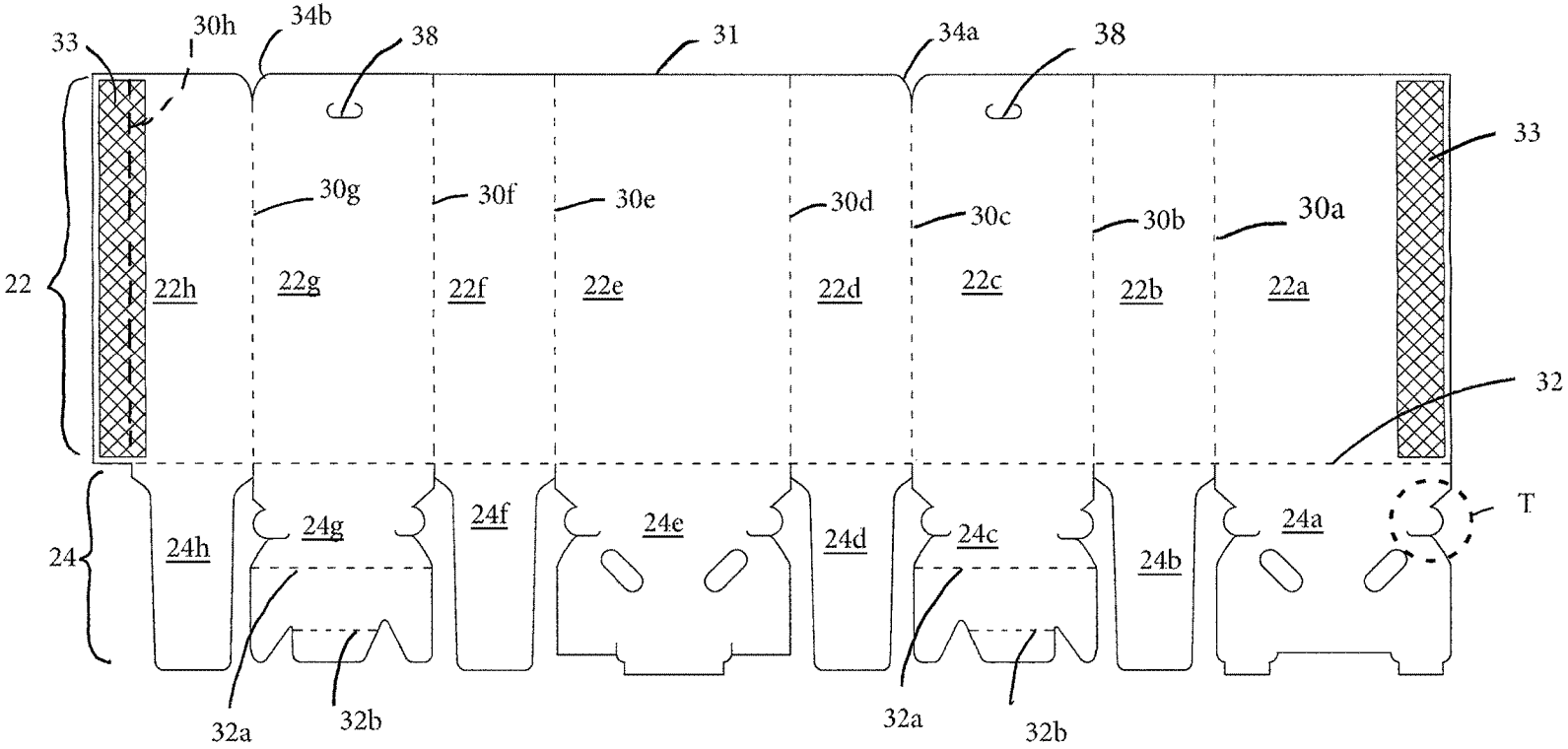
FIG. 5 is a view illustrating on a planar sheet, a pattern and folding configuration of the forming member and locking assembly of the bulk material container assembly of FIG. 4.

FIG. 5 is a view illustrating on a planar sheet the cut and fold pattern of the embodiment of the forming member and locking assembly portions of the container of FIG. 4. In the embodiment illustrated, the pattern is die cut from a corrugated substrate material, however as discussed above and in the incorporated U.S. Pat. No. 6,932,266, other substrate materials can be used.

Referring to FIG. 5, the substrate is scored along vertical fold lines 30*a*-30*h* that divide the forming member 22 into eight adjacent and integrally connected sidewalls 22*a*-22*h*. The sidewalls 22 extend between an upper edge 31 to a horizontal lower fold line 32 which also defines the upper boundary (as shown in FIG. 5) of the locking assembly member projections 24*a*-24*h*. Locking assembly member projections 24*a*-24*h* continuously extend respectively from sidewalls 22*a*-22*h*, and are joined thereto along the horizontal fold line 32. When the corrugated material which forms the forming member sidewalls 22 and the locking mechanism extensions 24 of the sidewalls 22 are folded along the fold lines 30 and 32 and interconnected to form the octagon shaped forming member configuration 22 of FIG. 4, the material at the fold line 32 defines the lower edges of the forming member sidewall segments 22*a*-22*h* as well as the outer edges of the locking assembly member projections 24*a*-24*h* that interconnect to form the locking mechanism of the container 20. The locking assembly members 24*c* and 24*g* also include secondary horizontal folding lines 32*a* and 32*b*, as illustrated in FIG. 5, that facilitate interconnection of the locking members during assembly of the container. The two end sidewalls 22*a* and 22*h* each has a vertical bonding strip portion, generally designated at the cross-hatched portions 33. The bonding strip portions 33 are sized, shaped and configured to overlap with and to be glued to one another when the forming member is operatively folded along the vertical fold lines 30*a*-30*h*, to operatively form a peripherally continuous three-dimensional forming member as illustrated in FIG. 4.

Figure 6A:
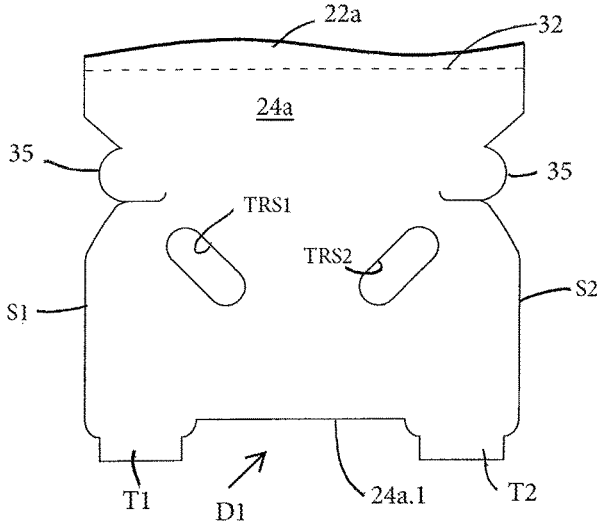
FIGS. 6A and 6B are enlarged views of two segments of the locking assembly portion of the bulk material container configuration of FIG. 5.

FIG. 6A is an enlarged view of the locking assembly member extension portion 24*a*. Referring thereto, the locking segment 24*a* is shown as extending between its proximal connection to the sidewall 22*a* along the fold line 32, and a distal end D1. The distal end D1 is configured to define a primary tab receptor slot 24*a*.1 and a pair of projecting tab portions T1 and T2 extending distally outward from the locking segment 24*a* on opposite sides of the primary tab receptor slot 24*a*.1. The locking segment 24*a* also has oppositely disposed side edges S1 and S2. Each of the side edges S1 and S2 has an outwardly projecting sleeve retaining tab member 35.

Figure 6B:
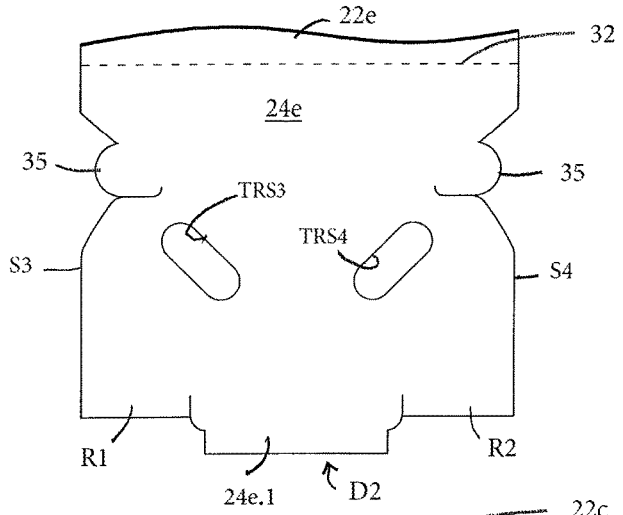

FIG. 6B is an enlarged view of the locking member extension portion 24*e*. Referring thereto, the locking segment 24*e* is shown as extending between its proximal connection to the sidewall 22*e* along the fold line 32, and a distal end D2. The distal end D2 is configured to define a primary tab 24*e*.1 outwardly projecting from the distal end D2, and a pair of tab receptor seat portions R1 and R2 spaced inwardly back from the distal end of the primary tab 24*e*.1 of the locking segment 24*e*, on opposite sides of the primary tab 24*e*.1. The locking segment 24*e* also has oppositely disposed side edges S3 and S4. Each of the side edges S3 and S4 has an outwardly projecting sleeve retaining tab member 35 of the same configuration as the same numbered sleeve retaining tab members of the locking segment 24*a* of FIG. 6A.

The locking segment 24*a* has a pair of laterally aligned and spaced, oppositely angled tab receptor slots TRS1 and TRS2, spaced back from the distal end D1 of the locking segment 24*a*. Similarly, the locking segment 24*e* has a pair of laterally aligned and spaced, oppositely angled tab receptor slots TRS3 and TRS4, spaced back from the distal end D2 of the locking segment 24*e*.

Figure 7:
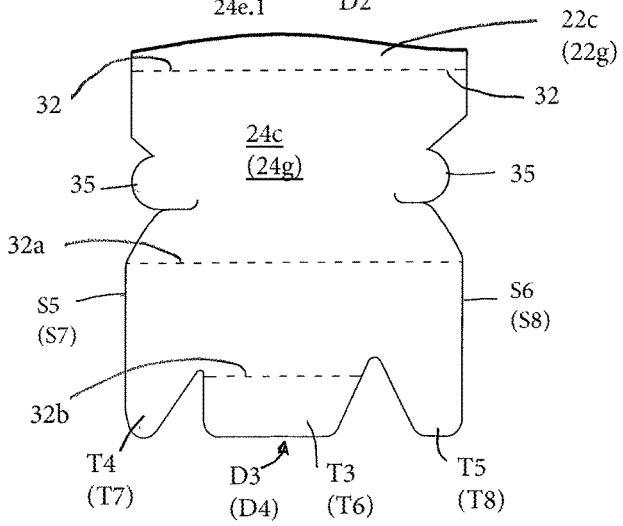
FIG. 7 is an enlarged view of a third segment of the locking assembly portion of the bulk material container configuration of FIG. 5.

FIG. 7 is an enlarged view of the locking member extension portions 24*c* and 24*g*, which are identically shaped. The numerical designations for the locking segment 24*g* are enclosed in parentheses in FIG. 7, and below the corresponding numerical designations for the locking segment 24*c*, which are not enclosed by parentheses. Referring thereto, the locking segments 24*c* (24*g*) are shown as extending between their proximal connection to the sidewalls 22*c* (22*g*) along the fold line 32, and a distal end D3 (D4). The locking segments 24*c* (24*g*) each has a primary tab portion T3 (T6) extending distally outward from the central portion of the locking segment 24*c* (24*g*). The locking segments 24*c* (24*g*) each also has a pair of projecting tab portions T4 (T7) and T5 (T8) extending distally outward from the locking segment 24*c* (24*g*) on opposite sides of the centrally located primary tab T3 (T6). The tab receptor slots TRS1-TRS4 of the locking member segments 24*a* and 24*e* are similarly sized and configured to matingly cooperatively receive and retainably engage the projecting tab members T4, T5, T7, and T8 of the locking member segments 24*c* and 24*g*, as hereinafter described in more detail.

The locking member segments 24*c* (24*g*) also have oppositely disposed side edges S5 (S7), S6 (S8). Each of the side edges S6-S8 as an outwardly projecting sleeve retaining tab member 35 of the same construction as those sleeve retaining tab members of like number of the locking segments 24*a* and 24*e*, previously described.

The sidewall lower extension segments 24*b*, 24*d*, 24*f* and 24*h* are identically shaped and are included within the designation of "locking assembly segments" since they share a common physical location below the lower fold line 32 and are cooperatively inwardly folded along with the other locking assembly segments, as hereinafter described, to define the 3-dimensional shape of the container. It will be noted that even though referred to as "locking" segments, while the lower extension segments 24*b*, 24*d*, 24*f* and 24*h* cooperatively sidably engage others of the locking assembly segments, they do not include any specific "interlocking" mechanisms like, for example, those of locking segments 24*a*, 24*c*, 24*e* and 24*g* previously described with reference to FIGS. 6A, 6B and 7.

Figure 8:
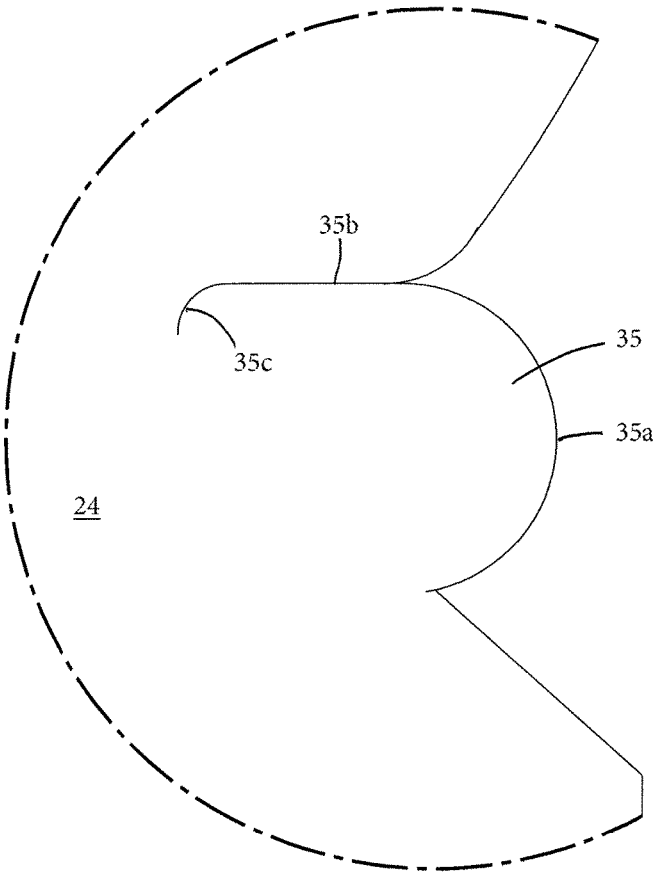
FIG. 8 is an enlarged fractional view of a sleeve retaining tab member of the locking assembly portion enclosed within the dashed circle "T" of FIG. 5.

An enlarged fragmentary view of one of the sleeve retaining tab members 35 illustrated within the dashed circle T of FIG. 5, is illustrated in FIG. 8. The tab 35 has an outwardly projecting arcuately-shaped edge portion 35*a*. The tab 35 has a second inwardly projecting edge portion 35*b* formed by a slit that projects into the base material of the extended locking member portion 24 from which the tab 35 is formed. The second edge portion 35*b* is formed by the same die-cutting operation that forms the tab 35, which cuts a slit through the locking member 24 base material. The slit forming the second tab edge portion 35*b* continuously extends into the body of the locking member segment 24 and terminates within the locking member 24 in a hook-shaped configuration illustrated at 35*c*. The second and third slit-formed portions 35*b* and 35*c* of the tab 35 are configured to retainably pinch and hold material of the sleeve 26 being retained by the tab 35, as hereinafter described in more detail. In one embodiment, the arcuately shaped edge portion 35*a* has a radius of about one inch and the combined length of the second and third slit-formed edge portions 35*b* and 35*c* is also about one inch. For the embodiment illustrated in FIG. 5, the die cutting operation also forms a pair of inverted retainer tab members 38 adjacent the top edge 31 of the forming member 22. The tabs 38 are used to retainably hold the upper end of the inner liner 28 in an operative open position within an assembled container 20 prior to and during loading of bulk material into the liner.

It is common practice in the industry for the forming member 22 and /locking mechanism 24 as shown in FIG. 5 to be manufactured separately from the outer support sleeve 26, and often by different manufacturers at different locations. The forming member 22/locking mechanism 24 configuration of the embodiment illustrated in FIG. 5 is formed by subjecting a planar substrate sheet of corrugated material to a die-cutting operation that defines the dimensions and shapes of the forming member 22 and the locking mechanism 24. The dimensioned and shaped corrugated panel then proceeds through various processing operations such as the forming (scoring) of fold line impressions, printing, folding, gluing operations, and the like, in manners well-known in the art.

Figure 9A:
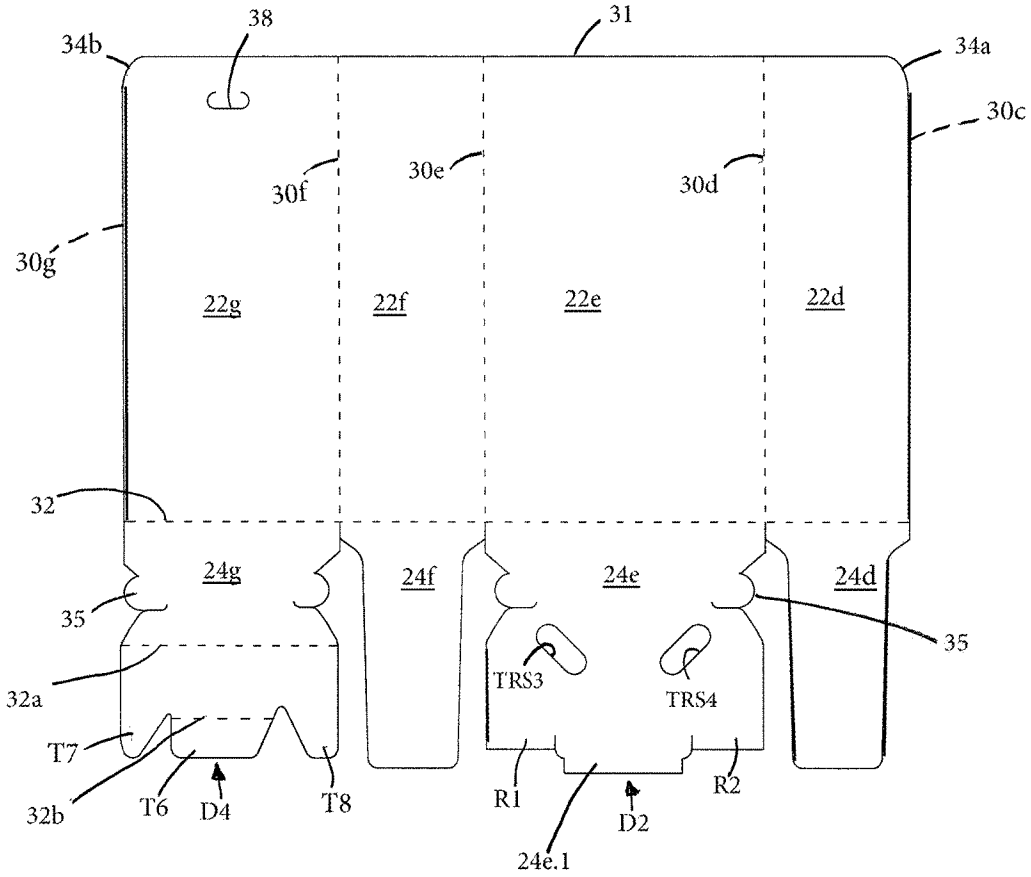
FIG. 9A is a view of one side of the forming member and locking assembly of FIG. 5 as it would appear when folded upon itself along the folding lines 30*c* and 30*g* of FIG. 5, with the opposite or back side thereof not shown.
Figure 9B:
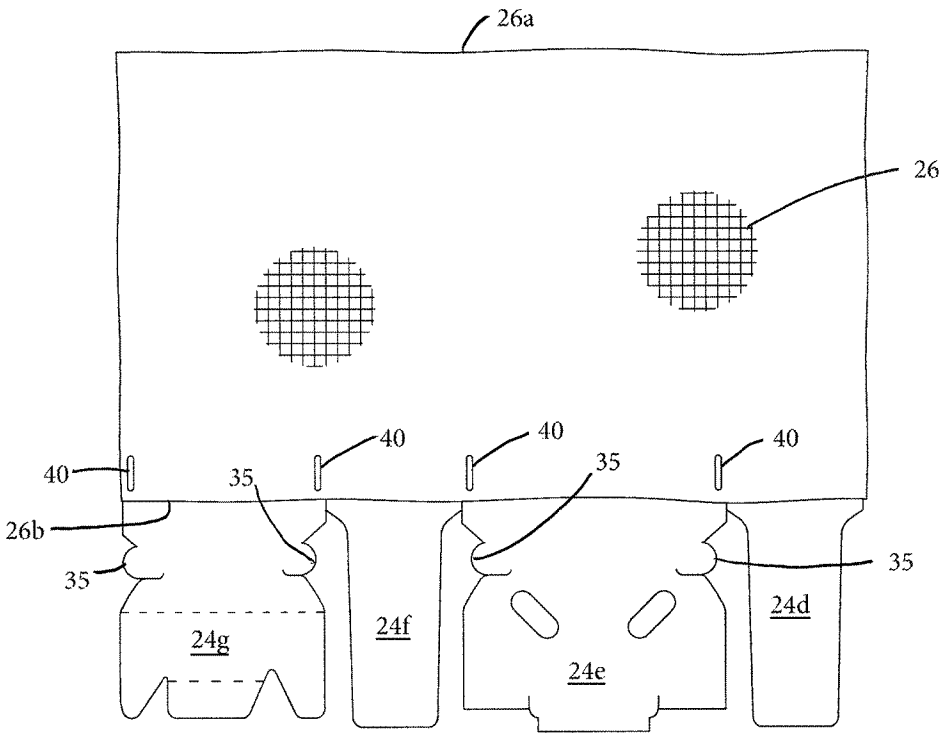
FIG. 9B is a view of the folded forming member and locking assembly of FIG. 9A shown with an outer sleeve pulled down over the top edge of the forming member and overlying the forming member, illustrating the vertical alignment of receptor slots in the sleeve with sleeve retaining tab members of the locking assembly.
Figure 9C:
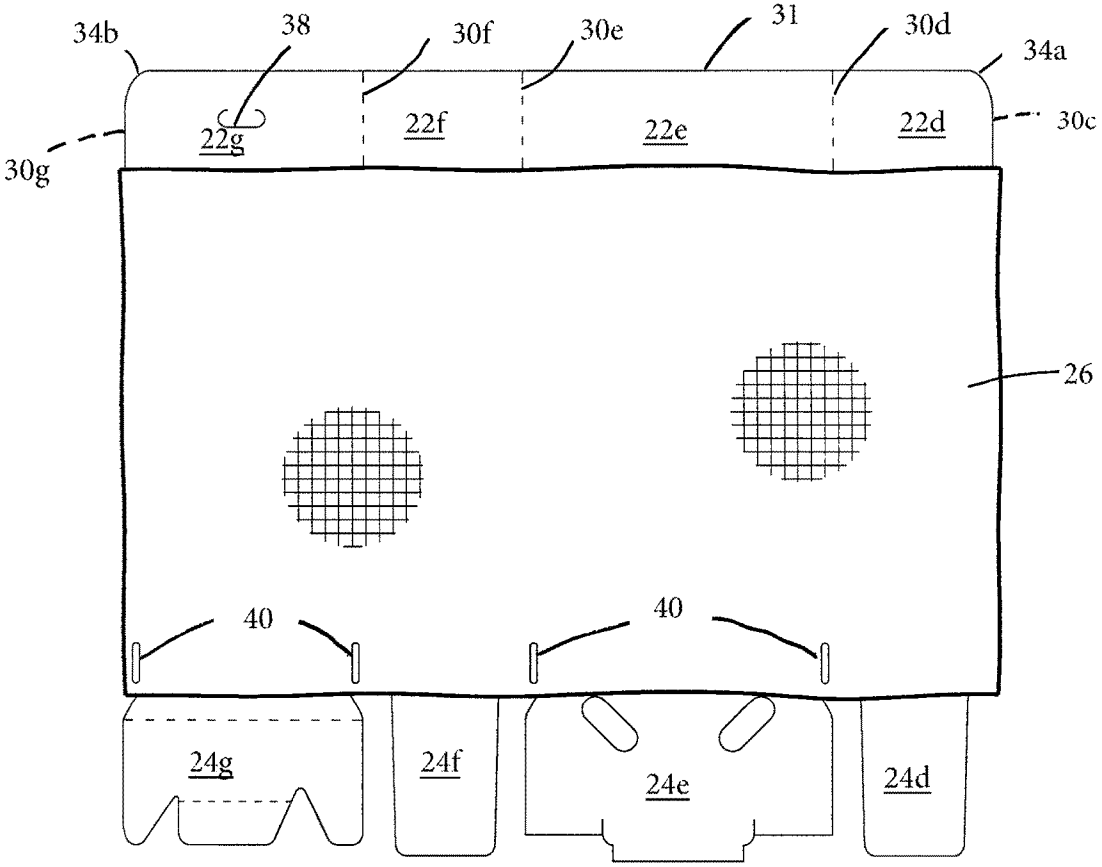
FIG. 9C is a view of the folded forming member and locking assembly of FIG. 9B, illustrating the outer sleeve pulled down to its operative position overlying the forming member, and partially overlying but not in operative engagement with the sleeve retaining tab members of the locking assembly.
Figure 10:
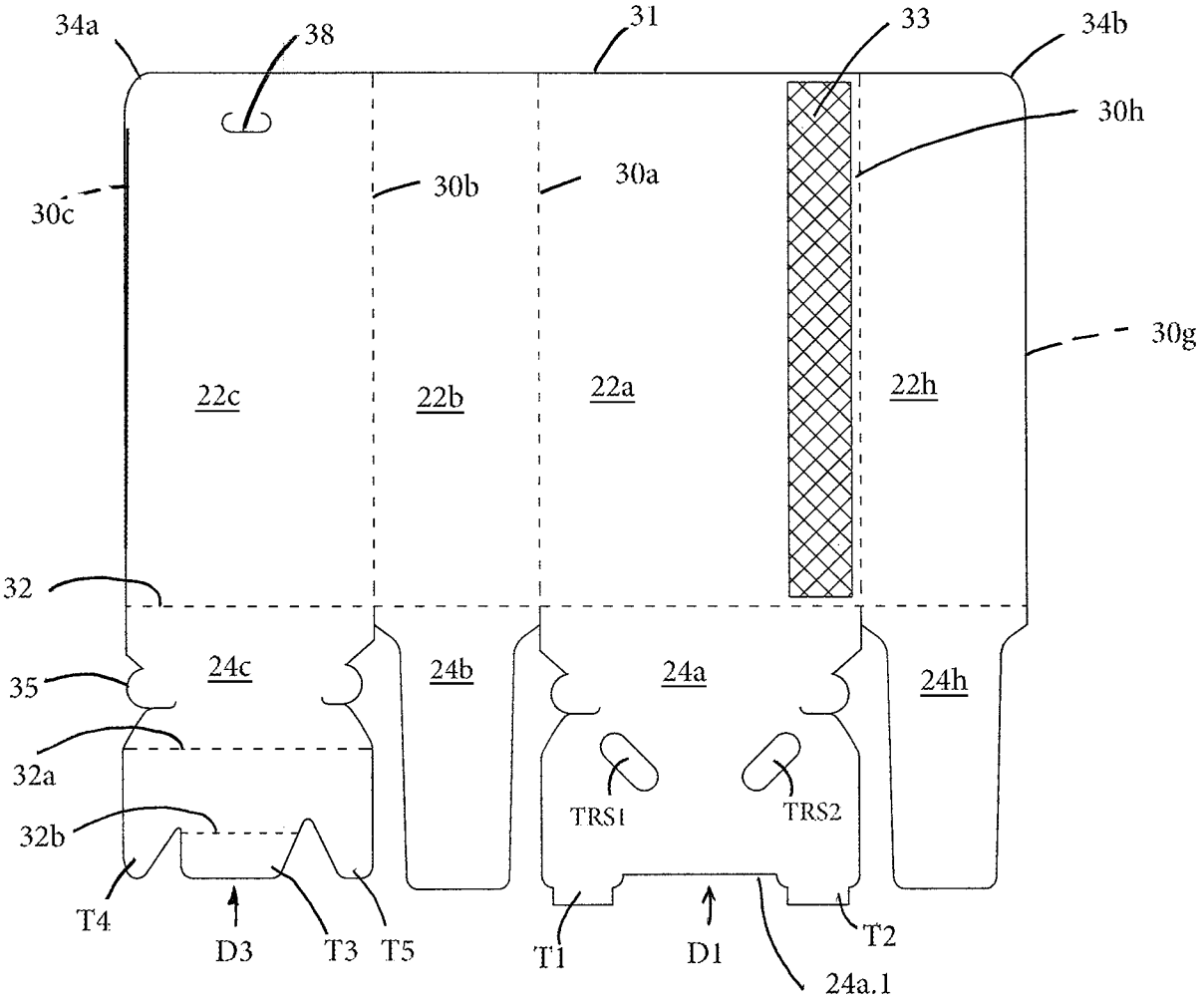
FIG. 10 is a view of the folded forming member of FIG. 9A, as viewed from the opposite side thereof, and with the back side thereof not shown.

For the embodiment illustrated in FIG. 5, the planar panel is folded in half along the fold lines 30*c* and 30*g* and glued along the bonding strip portions (33), to form the configuration shown in FIGS. 9 and 10. FIG. 9A is a view of one side of the folded assembly, showing the connected sidewall segments 22*d*, 22*e*, 22*f* and 22*g* of the forming member and their attached locking member extension portions 24*d*, 24*e*, 24*f* and 24*g* respectively. FIG. 10 is a view of the back or opposite side of the folded assembly of FIG. 9A, showing the sidewall segments 22*h*, 22*a*, 22*b* and 22*c* and their attached locking member extension portions 24*h*, 24*a*, 24*b* and 24*c* respectively. When viewing the folded configurations of FIGS. 9A and 10, the back or opposite sides of the folded panel are not illustrated in the respective Figures. FIG. 10 also shows the overlapping bonding strip portions 33 of the sidewalls 22*h* and 22*a*, which are glued together and compressed in a manufacture's joint in the glued/overlapped configuration, to form a continuously connected and folded forming wall structure that is ready for user assembly into an operable 3-dimensional structure. The folded and glued panel members as shown in FIGS. 9A and 10 can be readily stacked and bundled together for shipment to users thereof, or can have an outer sleeve attached thereto, as described below, before bundling and shipping.

Referring to FIG. 5, the upper edge 31 of the forming member 22 defines first and second triangular notches 34*a* and 34*b* die cut into the forming member panel and symmetrically centered respectively on the fold lines 30*c* and 30*g*. The first and second notches 34*a* and 34*b* reduce the effective width of the upper edge 31 of the half-folded assembly as related to the width of the folded assembly measured below the notches and between the side edges 30*c* and 30*g* of the folded assembly, as illustrated in FIGS. 9A and 10. This enhances/facilitates the placement and sliding assembly of the outer support sleeve 26 in overlying position onto and surrounding the forming member sidewalls.

The notches 34*a*, 34*b* can be shaped in a generally triangular manner with straight edges or with curved edges terminating in an apex along the fold lines 30*c*, 30*g* respectively. In a preferred embodiment of the forming member, the apex is positioned about 2 inches down from the top edge 31 of the forming member. The lateral positioning of the notches 34*a* and 34*b* along the upper edge 31 of the forming ember is selected so as to coincide with those vertical fold lines 30 that will form the outer lateral edges of the forming member 22 when folded in half. As shown in the embodiment illustrated in FIGS. 9 and 10 those half-folded outer edges coincide with the fold lines 30*c* and 30*g*.

The outer support sleeve 26 is preferably constructed of the same types of materials, well-known in the art, that are used for making flexible intermediate bulk containers (FIBCs). The sleeve is preferably configured from flexible woven fiber materials, preferably woven polyethylene materials which are known for their strength and light weight. The woven fibers can also or alternatively be polyethelene coated. The sleeve 26 is preferably of tubular and seamless construction, requiring no sewing or stitching. For assembly purposes, the sleeve material can simply be cut to a desired length by a shear or laser or by a hot knife technique that also conditions the woven material along the cut to prevent unraveling thereof. The sleeve 26 is sized to snugly engage and cover virtually the entire outer peripheral surface area of the forming member sidewalls 22*b*, and to extend slightly below the lower edge 32 of the assembled forming member for folding inwardly below the locking assembly, as hereinafter described.

Figure 11:
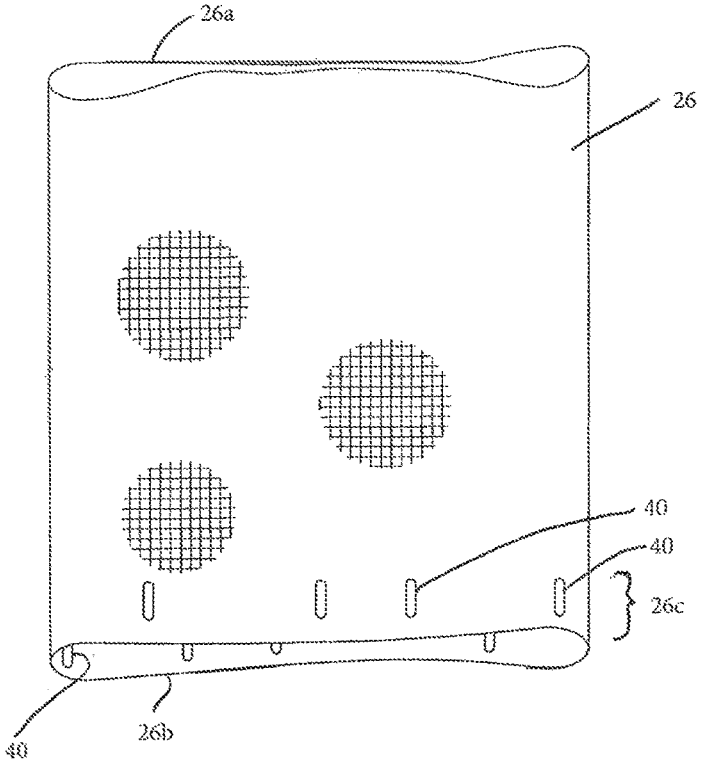
FIG. 11 is a diagrammatic pictorial view of an outer sleeve member illustrating circumferentially spaced receptor slots formed through the sleeve material adjacent a lower end thereof.

A diagrammatic pictorial view of an outer sleeve member described with respect to the container 20 herein is illustrated in FIG. 11. The sleeve extends from an upper edge 26*a* to a lower edge 26*b*. The sleeve includes a plurality of circumferentially spaced generally vertical slits 40 adjacent to but vertically spaced up from the lower edge 26*b* of the sleeve 26. The vertical slits 40 are circumferentially spaced around the perimeter of the sleeve 26 to cooperatively identically align with and to be cooperatively engagable with the sleeve retaining tab members 35 of the locking mechanism and form tab receptor slots for the tabs 35 of the locking mechanism 24. The slits 40 are preferably cut through the poly coated sleeve's surfaces and material with a hot blade or wire, that results in no unraveling of the exposed sleeve threads, in a manner well-recognized by those skilled in the art.

FIG. 9A illustrates the folded forming member 22/locking mechanism 24 as it would appear without any overlying sleeve 26. In the embodiment illustrated, the sleeve 26 is slidably secured in overlying manner to the folded FIG. 9A assembly by sliding it over the top edge 31 of the forming member 22 and downwardly along its sidewalls. The notches 34 formed in the upper edge 31 of the forming member assist in orientating and guiding the sleeve 26 over the forming member 22 and help to prevent the sleeve from catching on the upper corner edges formed by the folds 30*f* and 30*b* of the forming member as it is pulled down over the forming member.

FIG. 9B illustrates the folded forming member 22/locking mechanism 24 of FIG. 9A with the sleeve 26 as it would appear after being partially pulled down over the folded panel member, and illustrates the vertical alignment of the tab receptor slits 40 with the sleeve retaining tab members 35. FIG. 9C illustrates the sleeve 26 as it would appear when pulled down to an operative position relative to the underlying folded forming member 22/locking mechanism 24 panel of FIG. 9A, with the tab receptor slits 40 being cooperatively positioned in overlying manner to the sleeve retaining tab members 35, but without operative engagement between the tab receptor slits 40 and the sleeve retaining tab member 35. Sleeve attached assemblies as shown in FIG. 9C can be stacked and bundled for shipment to an end user who needs only to open the folded assembly of FIG. 9C, to erect it to form a 3-dimensional box-shaped configuration, to lock it into position by interlocking the lower locking member portions 24*a*-24*h* with one another, and to secure the sleeve 26 to the sleeve retaining tab members 35 as described below. Alternatively, as described above, the folded forming member 22/locking mechanism assemblies could also be shipped to a user without the attached sleeve 26 in cases wherein the user would first attach on overlying sleeve to the forming member while it is still configured in its flat folded-in-half condition, and prior to the user's 3-diminsional assembly of the container.

Figure 12A:
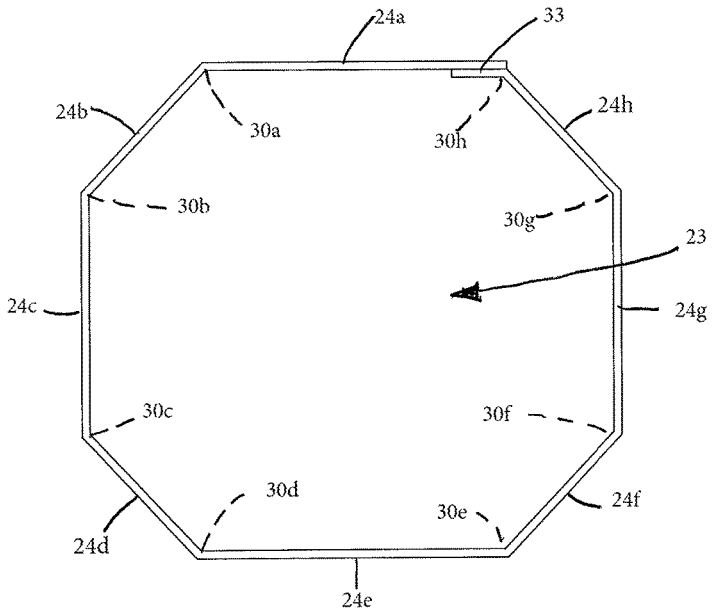
FIGS. 12A-12D illustrate bottom diagrammatic views of the forming member and locking assembly of FIGS. 9A and 10, showing progressive stages of folding and interconnection of the locking assembly portions to form a closed bottom locking configuration for the container that locks the sidewalls of the forming member in fixed relative spaced positions; that define the peripheral footprint of the container.

Assembly of the container into 3-dimensional form will be described with reference to the diagrammatic FIGS. 12-17. If the sleeve 26 is not yet been assembled to the folded forming member 22/locking member 24 as shown in FIG. 9C, the user or assembler would first slide the sleeve 26 over the forming member 22/locking mechanism assembly 24 as described above with respect to FIGS. 9A-9C. The forming member 22/locking member assembly 24/sleeve combination is then inverted and placed on a generally planar support surface with the upper edge 31 of the forming member resting on the support surface, and its sidewalls 22 are pulled "open" or apart, to define an internal geometric solid shaped cavity 23, as shown in FIG. 12A. FIG. 12A is a view of the inverted forming member 22/locking mechanism 24 assembly of FIG. 9 as it would appear looking down at the bottom of the assembly and folded along the fold lines 30*a*-30*g*. In the embodiment shown, since there are eight sidewall portions 22*a*-22*h* and connected locking member extension portions 24*a*-24*h*, the internal geometric volume enclosed by the assembly is an eight sided octagon shape. It will be noted that the diagrams of FIG. 12 are diagrammatic only and not true cross-sectional or plan views of the container. FIG. 12A is a view of the bottom edges of the locking member extensions 24 as they would appear "coming out" of the plane of and generally perpendicular to the plane of the paper. It will also be noted, that the outer support sleeve 26 is not illustrated in FIG. 12.

Figure 12B:
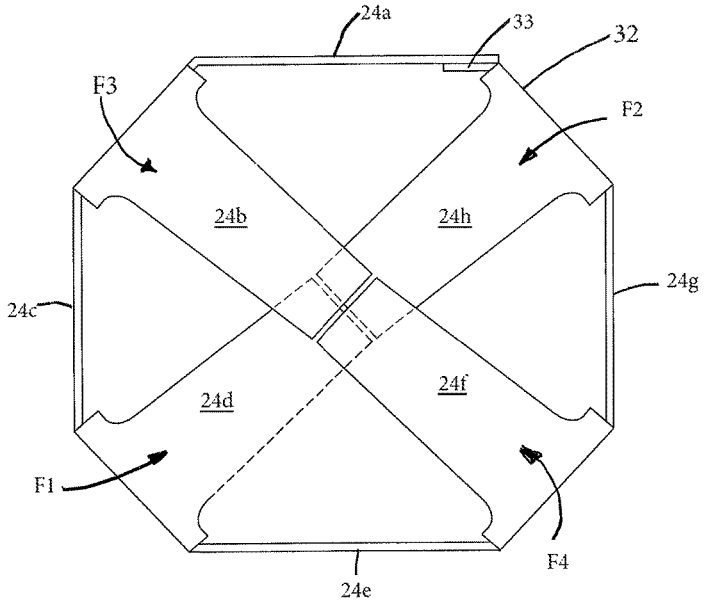
Figure 12C:
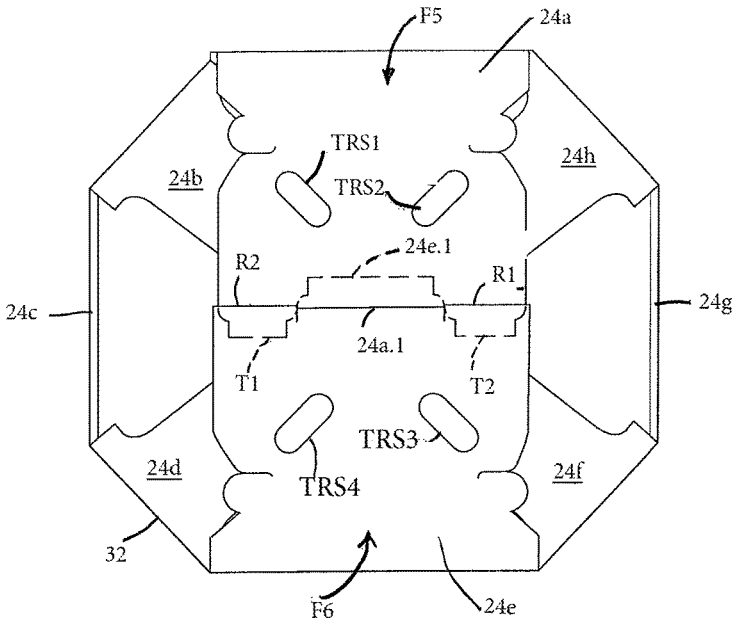
Figure 12D:
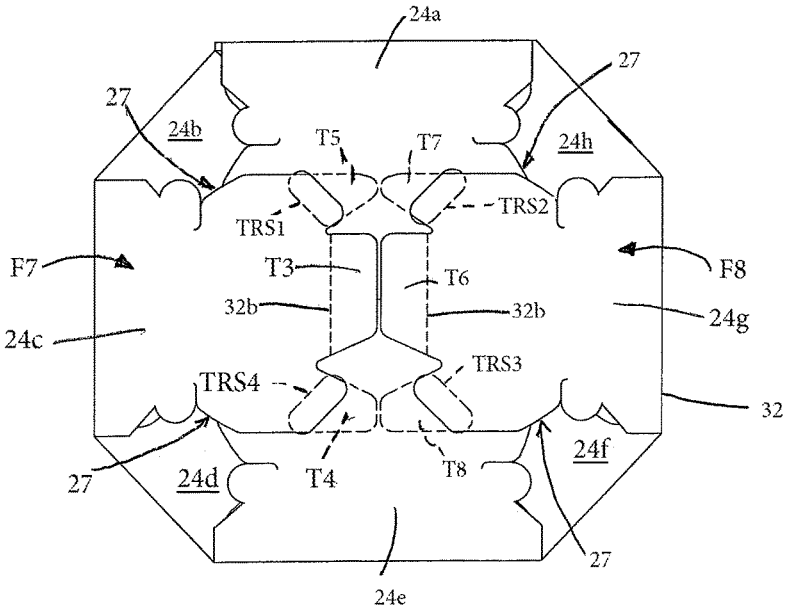

Referring to FIG. 12B, the first segments of the locking assembly to be inwardly folded as shown by the arrows F1-F4, are the four identically shaped segments 24*b*, 24*d*, 24*f* and 24*h*. When folded inwardly toward the center of the container as shown in FIG. 12B, their distal ends overlap near the center of the container footprint. These segments form the innermost members of the bottom of the container and of the enclosed internal geometric volume 23. Continuing the container assembly, as shown in FIG. 12C, locking segments 24*a* and 24*e* are folded inwardly toward one another as shown by the arrows F5 and F6 respectively. The distal ends D1 and D2 respectively of the locking segments 24*a* and 24*e*, cooperatively retainably engage one another near the center of the container such that the primary tab 24*e*.1 of the segment 24*e* is received by the primary tab receptor slot 24*a*.1, and tucks under the locking segment 24*a*. The outer tab members T1 and T2 of the locking segment 24*a* are cooperative respectively received by and slide under the tab receptor seat portions R2 and R1 of the locking segment 24*e*. Referring to FIG. 12D, the final two locking segments 24*c* and 24*g* are folded inwardly toward each other as shown by the arrows F7 and F8 respectively and interlock with the underlying locking segments 24*a* and 24*e*. The primary tab portions T3 and T6 of the locking segments 24*c* and 24*g* respectively, overlie the upper surfaces of locking segments 24*a* and 24*e*. The outer tab portion T4 of the locking segments 24*c* is cooperatively retainably received by the tab receptor slot TRS4 of the locking member 24*e*, and the outer tab T5 of the locking segment 24*c* is cooperatively retainably received by the tab receptor slot TRS1 of the locking member 24*a*. Similarly, the outer projecting tabs T7 and T8 of the locking member 24*g* are cooperatively retainably received by the tab receptor slots TRS2 and TRS3 receptively of the locking segments 24*a* and 24*e*, to complete the locking configuration of the locking assembly segments, as illustrated in FIG. 12D. The fold lines 32*a* and 32*b* of locking member segments 24*c* and 24*g* provide bending flexibility of the locking segments 24*c* and 24*g* when being maneuvered during assembly of the container, to engage their respective tab members T4, T5, T7 and T8 within that tab receptor slots of the locking segments 24*a* and 24*e*.

The interconnected locking members as described above and as shown in FIG. 12D form vertical gaps generally depicted at 27, between the first folded corner segments 24*b*, 24*d*, 24*f* and 24*h* and the overlying locking member segments 24*a*, 24*c*, 24*e* and 24*g* into which portions of the folded over sleeve 26 can be tucked as described below. It will be noted that when the completed container is inverted from the inverted "assembly" positions shown in FIGS. 12-14, to its upright, operative position for receiving bulk material as shown in FIG. 4, that the corner segments 24*b*, 24*d*, 24*f* and 24*h* of the locking assembly will be positioned so as to "overlie" the locking member segments 24*a*, 24*c*, 24*e* and 24*g*.

Figure 13:
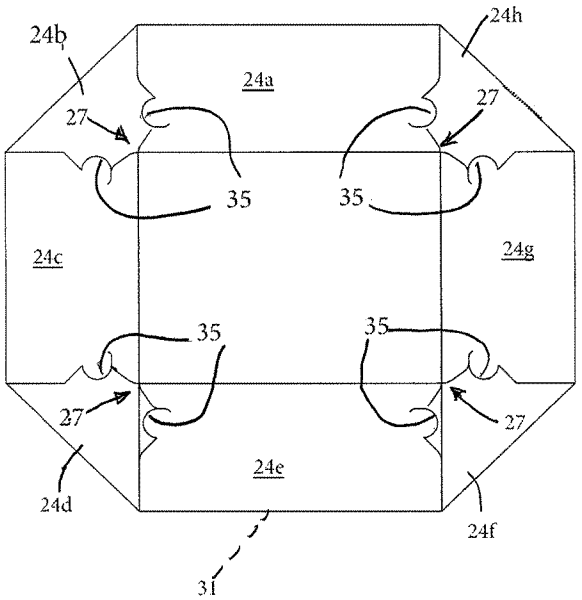
FIG. 13 is a diagrammatic bottom view of the assembled and interconnected locking assembly segments, illustrating the sleeve retaining tab members and their positioning relative to one another and to the corner sleeve receiving gap portions formed by the locking assembly.

FIG. 13 is a simplified diagrammatic bottom view of the assembled locking member segments, illustrating the relative opposed operative spaced positions of the sleeve retaining tab members 35 and of the positions relative thereto of the sleeve retaining gaps 27. The terminology "opposed operative positions" of the tab members 35 refers to each pair of the tab members 35 that are on the same locking member segment, and to the fact that the outward directions (i.e., the directions in which the arcuate end portions 35*a* of the tabs point) of the tab pairs point in "opposite" lateral directions relative to the locking segment from which they are formed, so as to tautly secure a segment of the outer sleeve 26 secured therebetween, as hereinafter described in more detail. Each of the locking segments 24*a*, 24*c*, 24*e* and 24*g* has a pair of operatively opposed and accurately spaced tab members 35.

As shown in FIG. 13, each of the corner segment locations 24*b*, 24*d*, 24*f* and 24*h* that provide access to the sleeve retaining gaps 27 has an adjacent pair of the sleeve retaining tabs 35 aligned to face each other on opposite sides of the triangular shaped gaps 27. These tabs 35 are positioned near the apex of the triangular shaped gaps 27.

Figure 14:
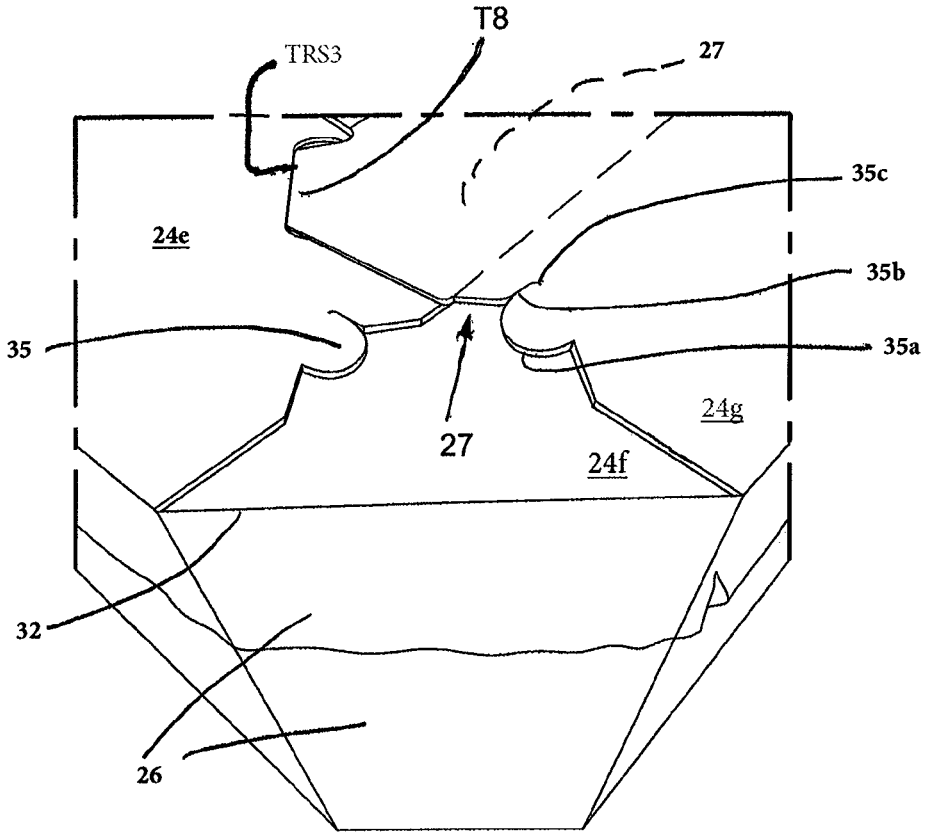
FIG. 14 is an enlarged perspective view of one of the sleeve receiving gap portions of the locking assembly of FIG. 13.

FIG. 14 is an enlarged perspective pictorial view of one of the sleeve receiving gap portions 27 of FIG. 13, illustrating the adjacent pair of sleeve retaining tabs 35, and illustrating a portion of the sleeve 26 shown folded down from the lower folded edge 32 of the sidewall 22 and along the sidewall 22, prior to folding the sleeve 26 in the up direction as viewed in FIG. 14, and inwardly over the locking assembly segments 24. The gap 27 illustrated in FIG. 14 is the one formed between the lower folded segment 24*f* and the overlying locking members 24*e* and 24*g*.

Figure 1:
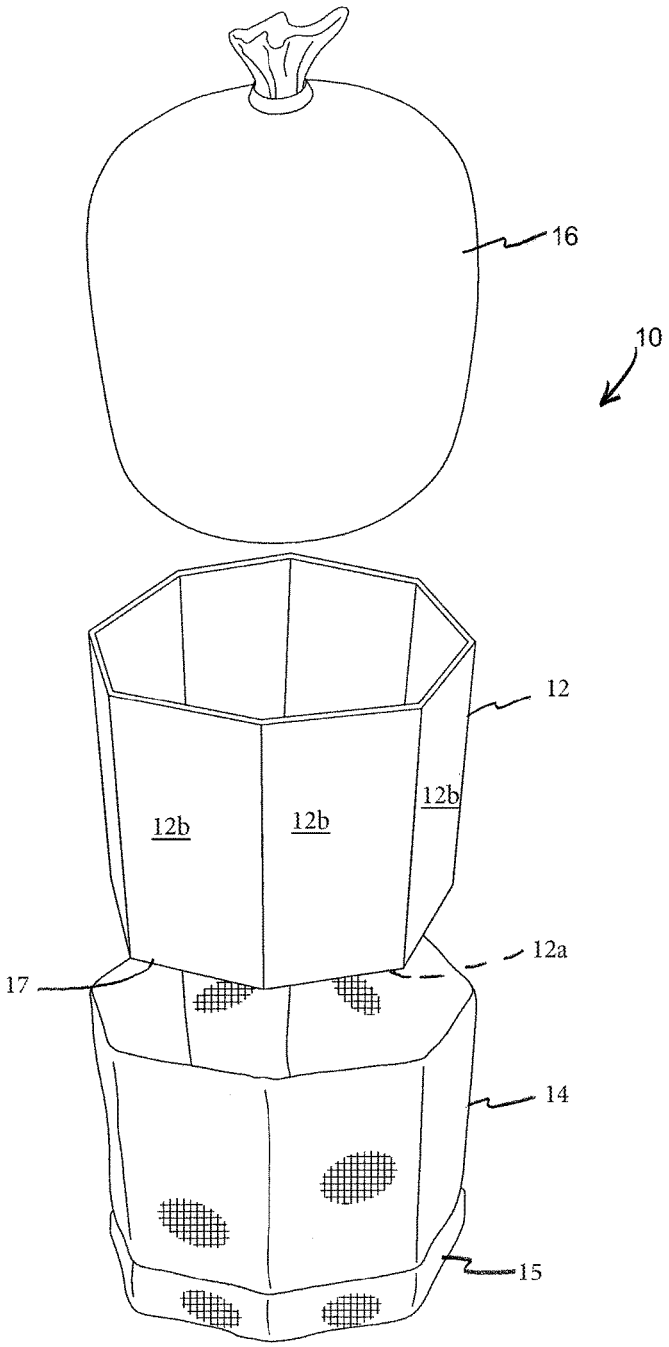
FIG. 1 PRIOR ART
FIG. 1 is an exploded perspective view of a bulk material container assembly of the prior art containing a forming member, an outer sleeve member and an optional bag/liner.
Figure 2:
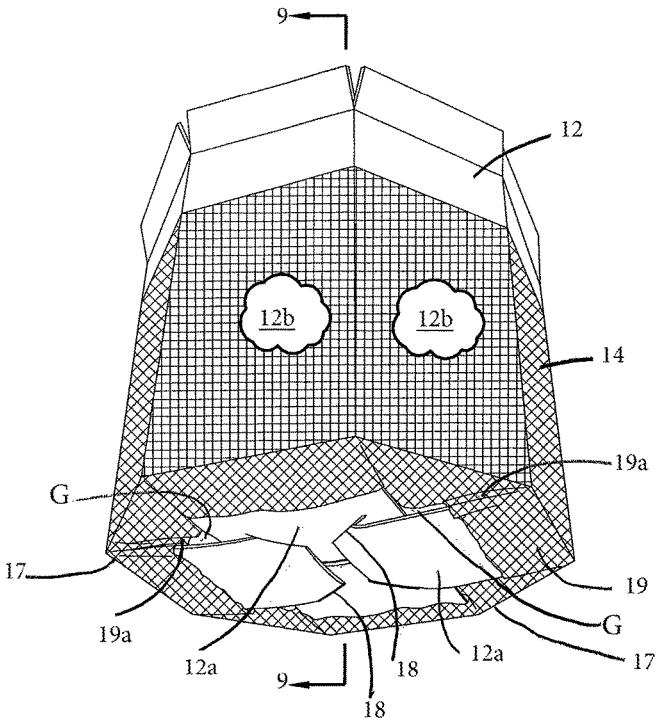
FIG. 2 PRIOR ART
FIG. 2 is a bottom perspective view illustrating another prior art embodiment of a bulk material container assembly containing a forming member, an outer sleeve member and a forming member locking assembly illustrating how the outer sleeve member may be folded under the forming member and tucked into gaps formed at the bottom of the container when it is fully assembled.
Figure 3:
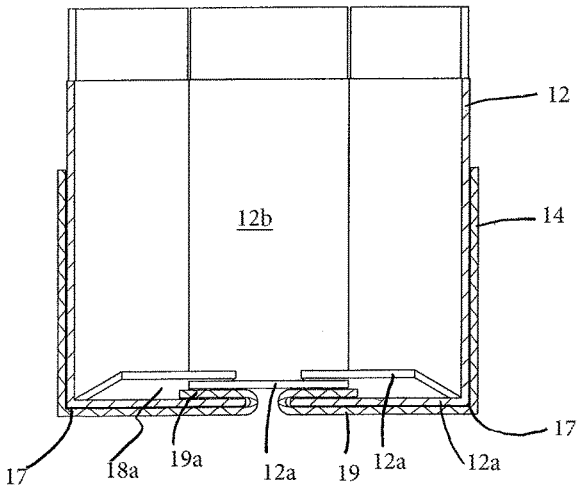
FIG. 3 PRIOR ART
FIG. 3 is a vertical sectional view taken generally along the Line 9-9 of FIG. 2.

As shown in FIGS. 2 and 3, it is known to fold a lower portion 19 of a sleeve 14 over the lower edges 17 of a forming member sidewall 12*b* and inwardly toward the internal cavity. It also known to tuck excess portions of the folded undersleeve portion into the gaps "G" formed at the bottom of the fully assembled forming member, as shown at 19*a*. However, other than for frictionally tucking the sleeve material 19*a* into the forming member gaps "G", no known mechanism has been provided in the past for ensuring that the folded-under sleeve material remains secured or locked into the folded and tucked under positions as shown in FIGS. 2 and 3, during subsequent movement and handling of the assembled container, prior to its filling with bulk material. Rough or mishandling of prior known assembled containers has at times caused portions of the lower sleeve to loosen and retract from its tucked-in configuration so as to extend outwardly on a pallet beyond the container footprint, diminishing the ability of the lower portion of the sleeve to counteract the increased bulk material pressure near the bottom of the container sidewalls—where the sleeve is needed the most. Once the sleeve material is moved beyond the outer periphery of the sidewalls, pressure exerted on the lower portion of the sidewall during loading of bulk material into the container can cause the sidewall to bulge outwardly, causing the sleeve material to ride up along the sidewall and possibly leading to rupture of the lower sidewall which is then no longer supported by the sleeve. Further, such undesired movement of the sleeve out of its tucked-in position in the gaps "G" can also lead to instability of the entire container during transport.

The present invention provides a securement system for ensuring that the outer support sleeve 26 remains in the desired fixed tucked-in position after operative assembly of the container, regardless of the extent of the movement, sliding or jarring of the assembled container, prior to being filled with bulk material. The sleeve retaining tab members 35 and the spaced slits 40 along the lower portion of the sleeve 26 form a securement system for securing the sleeve 26 to the locking system tabs 35. The tabs 35 and slits 40 are cooperatively sized, shaped and positioned to precisely cooperatively retainably engage one another as the sleeve material is peripherally folded inwardly and along the bottom edge of the container during assembly thereof.

Figure 15:
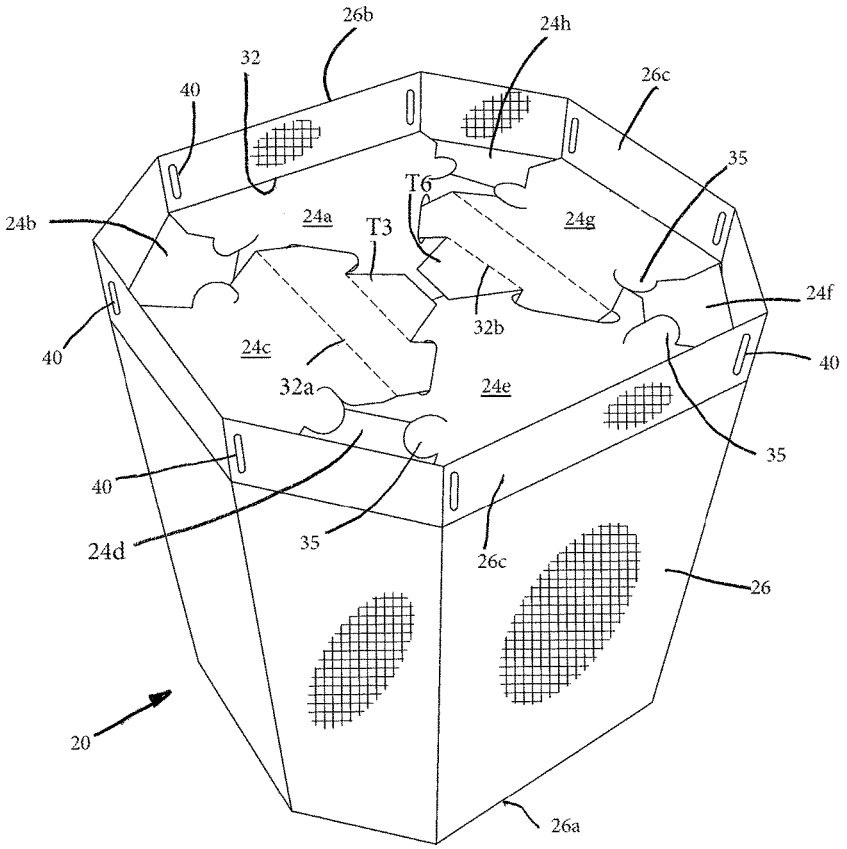
FIG. 15 is a pictorial bottom/side perspective view of the bulk material container during assembly, illustrating the bottom portion of the sleeve positioned in an extended manner below the general plane of the assembled locking assembly bottom of the container, as it would appear prior to folding it inwardly against and operatively connecting it to the sleeve retaining tab members of the locking assembly.
Figure 16:
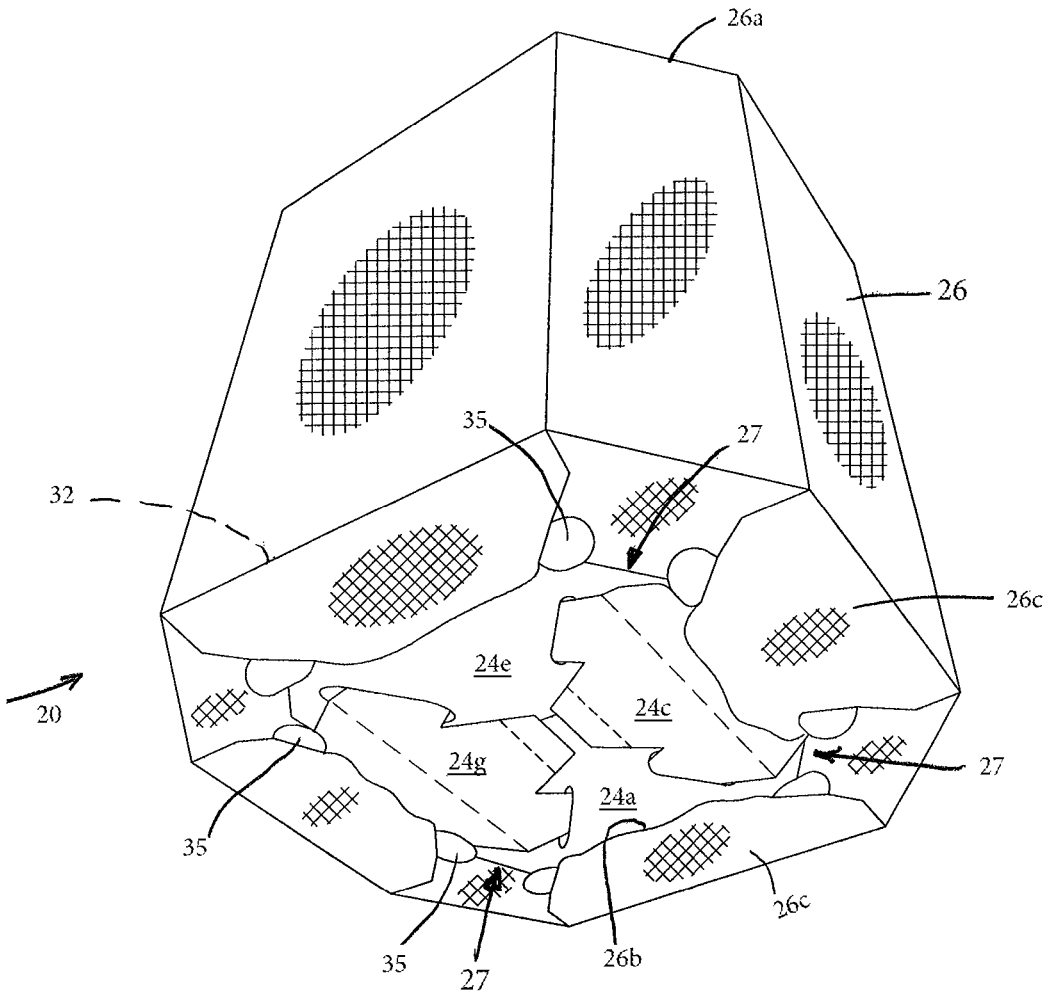
FIG. 16 is a pictorial bottom/side perspective view of the completed assembly of the bulk material container of FIG. 15, illustrating the sleeve folded against the bottom of the container with its receptor slots operatively engaging and connected to the sleeve retaining tab members of the locking assembly and with the excess sleeve material at the bottom corners of the forming member tucked into and retained within the sleeve receiving gap portions of the locking assembly.

FIG. 15 is a pictorial illustration of the container in inverted position after assembly of the locking members 24, as described with respect to FIG. 12, showing the outer support sleeve 26 operatively positioned over the sidewalls of the forming member 22 and having its lower portion 26*c* distally extending to its lower edge 26*b* beyond the general plane of the locking assembly 24. The lower sleeve portion 26*c* includes the plurality of vertical slits 40, each sized to cooperatively retainably engage one of the sleeves retaining tab members 35. The slits 40 are peripherally spaced along the circumference of the sleeve so as to exactly align with the sleeve retaining tab members 35 formed on the locking member segments, as previously illustrated in FIGS. 9B and 9C. To engage the sleeve 26 to the sleeve retaining tab members 35, the assembler generally with one hand, pushes and folds one section of the bottom sleeve portion 26*c* extending distally from the bottom of one of the sidewalls 22*a*, 22*c*, 22*e* or 22*g* of the forming member 22, inwardly toward the center of the container and against the upper surface of the locking assembly (as viewed in FIG. 15). When folded against and into engagement with the corresponding generally planar locking assembly surface 24*a*, 24*c*, 24*e* or 24*g* the slots 40 of the sleeve bottom portion 26*c* will be positioned in overlying juxtaposition with two of the operatively opposed sleeve engaging tabs 35 extending from the corresponding locking segment 24*a*, 24*c*, 24*e* or 24*g*. After inwardly folding the section 26*c* of the sleeve over the locking segment, the assembly worker grasps opposed end portions of the sleeve extension 26*c* and slides a first end of the sleeve extension portion laterally outward along the top surface of one of the protruding sleeve retaining tab members 35 until the tab 35 begins to slide into the overlying slot 40 of the sleeve. As the tab edge 35*a* cooperatively proceeds into and through the slot 40, the sleeve material adjacent the slot 40 continues to slide into the slit portion 35*b* of the tab assembly and finally proceeds into the terminating hook-shaped end configuration 35*c* of the tab 35, securely pinching and retainably securing the sleeve portion 26*c* to the tab 35 engaged through the slot 40. The assembler performs the same sliding motion (in reverse in the opposite lateral direction) for the other, second end of the strip of sleeve material portion 26*c* he is grasping, securing the second end of the sleeve portion 26*c* to the tab assembly 35. The pair of opposed tabs 35 and their corresponding sleeve slits 40 are cooperatively spaced and aligned such that when both ends of the engaged sleeve strip 26*c* have been secured in opposite directions to the opposed tab members 35, the intermediate sleeve material 27*c* will be tautly stretched between the opposed pair of tabs 35. The assembler works his way around the inverted container, repeating this sleeve securing procedure for each of the distally extending sleeve portions 26*c* for the remaining sidewalls 22*a*, 22*c*, 22*e* and 22*g* as they are folded inwardly over the lower edge 32 of the sidewalls, until the sleeve material 26*c* adjacent the lower edge of each sidewall is securely and tautly fastened to the respectively opposed pairs of sleeve retaining tabs 35, of the locking assembly segments 24*a*, 24*c*, 24*e* and 24*g*. The excess sleeve 26*c* material that naturally bunches up between adjacent secured ends of the sleeve material 26*c* in the vicinity of the sleeve retaining gaps 27, is then rapidly folded and tucked into the sleeve retaining gaps 27, of the locking assembly to complete the container assembly, as shown in FIG. 16, wherein the container 20 is shown inverted from that of the previous assembly steps, back to its normal operative position, for placement on a pallet and subsequent bulk material filling. While the illustrations in FIGS. 15 and 16 show the top 26*a* of sleeve 26 extending all the way to the top of the sidewalls 22, the top edge 26*a* of the finally positioned sleeve 26 is typically slightly below the top edge 31 of the sidewalls, as illustrated in FIG. 9C.

Figure 17:
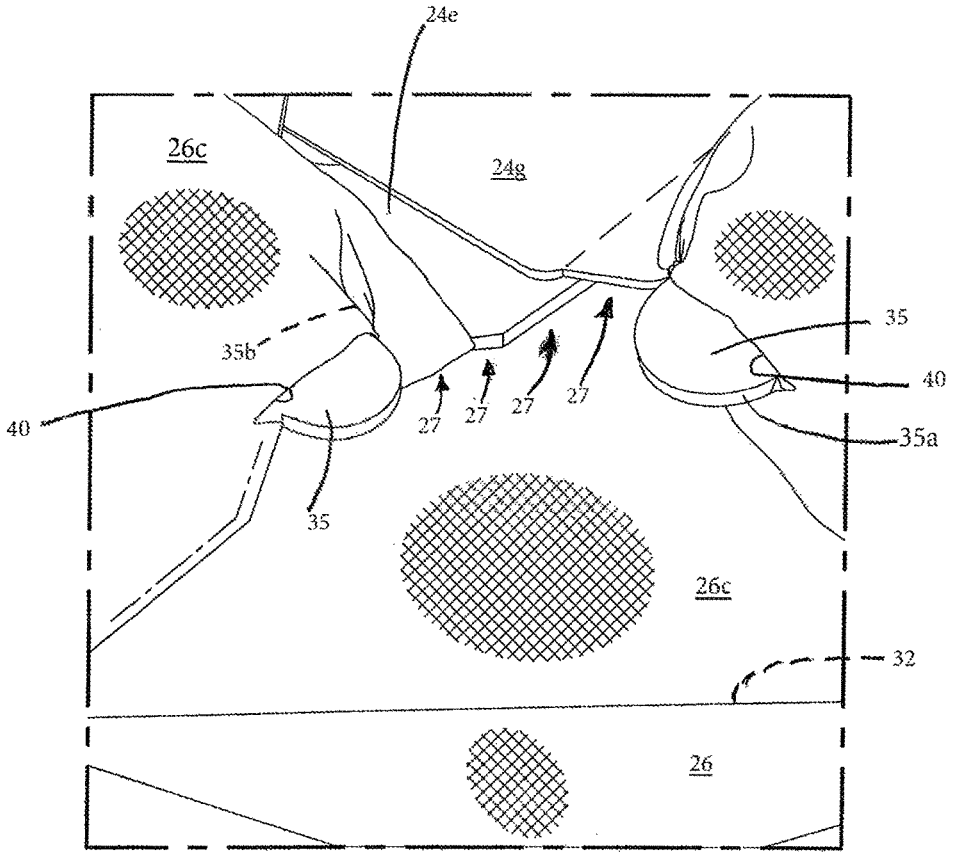
FIG. 17 is an enlarged perspective fractional pictorial view of one of the bottom sleeve retaining tab and gap portions of the assembled bulk material container of FIG. 16.

FIG. 17 is an enlarged pictorial view similar to that of FIG. 14 illustrating cooperative engagement of two adjacent sleeve retainer tab members 35 with slots 40 of the sleeve 26, and the tucking under of excessive sleeve material between the adjacent tab members 35 into the adjoining sleeve retaining gap 27.

The entire process of securing the lower portion 26*c* of the outer support sleeve 26 to that sleeve retaining tabs 40 is performed rapidly due to repetition of the process. Further, the assembly step does not add any significant time to prior container assembly processes since the prior assembly practice performed the same folding and tucking operations on prior bulk containers that did not contain any positive sleeve securement structures or procedures such as provided by this invention. The taut nature of the secured sleeve portions 26*c* against the bottom of the locking assembly and placement of the securing tabs adjacent the apex of the sleeve retaining gaps 27 combine to retainably hold and maintain the tucked-in sleeve material within the gaps 27, by the reducing the chance of the tucked-in sleeve material from being snagged and pulled out from the slot during handling of the assembled but unfilled container. As stated above, once filling of the container begins and the weight of the contained bulk material increases, downward pressure exerted by the material on the lower locking assembly portions forming the sleeve retaining gaps 27 increases, tightly sandwiching and retainably holding the sleeve material therebetween as the loading pressure continue to increase and is maintained during transport of the container.

Once assembled, the container can be inverted to its operative position and placed on a pallet for filling with bulk material as illustrated in FIG. 4 in conventional manner. If desired, an optional inner liner 28 can be inserted within the forming member 22 as is known in the art and described in more detail in the incorporated U.S. Pat. No. 6,932,266. The liner 28 can be secured along its open upper end by the tabs 38, to maintain it in a "open" position during its filling by the bulk material.

Providing positive securement of the outer support sleeve 26 to the bottom of the container provides a container assembly that offers consistent quality and improved reliability without additional assembly labor or material costs.

This specification provides one example of an embodiment of a bulk material container incorporating the principles of this invention. Other embodiments of the invention can be made without departing from the spirit and scope of the invention, which resides in the claims hereinafter appended.

What is claimed is:

1. A container for bulk materials, comprising:

(a) a forming member comprising a plurality of foldably interconnected sidewalls extending between upper and lower edges and operative when folded to cooperatively form and encircle an internal cavity for receiving bulk materials;

(b) a locking assembly cooperatively engaging said sidewalls to define and fix the sidewalls in predetermined relative positions, said locking assembly forming at least in part a bottom surface of said cavity;

(c) an outer sleeve with opposed open ends, made of continuous woven material sized, arranged and configured to slidably and snugly engage and overlie substantially the entire outer surfaces of said sidewalls and having a lower extended portion configured to extend below said lower edges of said sidewalls;

(d) wherein said lower extended portion of said sleeve is folded inwardly along said sidewall lower edges toward said internal cavity and in underlying engagement with said locking assembly; and (e) cooperatively couplable fasteners on said outer sleeve and on said locking assembly, operative when coupled to secure said inwardly folded portion of said sleeve to said locking assembly below said bottom surface, thereby preventing said sleeve from upward movement along said sidewalls.

2. The container as recited in claim 1, wherein said forming member and said locking assembly comprise a single piece of material.

3. The container as recited in claim 2, wherein said single piece of material comprises corrugated material.

4. The container as recited in claim 1, wherein said couplable fasteners comprise a first pair of fasteners on said locking assembly and a second pair of fasteners on said sleeve, operatively aligned and engagable with said first pair of fasteners; and wherein said first and said second pair of fasteners are cooperatively arranged and configured such that when operatively coupled, pull said sleeve material taut between said first pair of fasteners and against said locking assembly.

5. The container as recited in claim 1, wherein said cooperatively couplable fasteners of said locking assembly comprise a pair of opposed spaced tabs, and wherein said cooperatively couplable fasteners of said sleeve comprise a pair of spaced slots formed through said sleeve material and arranged and configured to operatively and retainably align and couple with said tabs of said locking assembly.

6. The container as recited in claim 5, wherein said locking assembly comprises corrugated material.

7. The container as recited in claim 6, wherein said tabs have a first outwardly projecting arcuate edge portion configured to cooperatively engagably slide through said slots of said sleeve.

8. The container as recited in claim 7, wherein said tabs have a second edge portion continuously extending from said first edge portion and defined by a slit through said corrugated material.

9. The container as recited in claim 8, wherein said slit and second edge portion terminates in a hook configuration defining a third edge portion of said tabs.

10. The container as recited in claim 1, wherein said locking assembly is configured to be operatively connected to and to be foldable with said forming member.

11. The container as recited in claim 1, wherein said outer sleeve can be operatively positioned overlying said forming member by sliding said sleeve over said sidewalls from either their said upper or lower edges.

12. The container as recited in claim 11, wherein said sleeve is slid onto said forming member when said forming member is in a collapsed folded configuration.

13. The container as recited in claim 12, wherein said forming member when in said collapsed folded configuration comprises a generally planar structure with said upper sidewall edge over which the sleeve slides forming a generally elongated end of said planar structure, extending between opposed first and second side ends of the collapsed folded configuration, and wherein the first and second opposed side ends have cutout portions extending from said elongated end to facilitate sliding of said sleeve over said elongated end.

14. A bulk material container kit, comprising:

(a) a collapsible forming member comprising a plurality of interconnected sidewalls extending between upper and lower edges and foldable to cooperatively form an outer peripheral sidewall structure that encircles an internal cavity for receiving bulk materials;

(b) a collapsible locking assembly cooperatively engagable with said forming member sidewalls to define and fix predetermined relative positions of said sidewalls and to form at least in part a bottom surface of said internal cavity;

(c) an outer sleeve with opposed open ends, comprising continuous woven material, with an upper portion sized, arranged and configured to slidably and snugly engage and overlie substantially the entire outer surfaces of said sidewalls, and with a lower portion continuously extending from said upper portion and sized, arranged and configured to extend below said lower edges of said sidewalls for folding inwardly along said lower edges in a direction toward said internal cavity and in underlying engagement with said locking assembly; and (d) cooperatively couplable fasteners on said lower portion of said outer sleeve and on said locking assembly, of a type that when operatively coupled secure inwardly folded portions of said sleeve to said locking assembly to prevent said sleeve from upward movement along said sidewalls.

15. The kit as recited in claim 14, wherein said forming member and said locking assembly comprise a single piece of material.

16. The kit as recited in claim 14, wherein said cooperatively couplable fasteners comprise a first set of opposed spaced fasteners on said locking assembly, and a second set of fasteners comprising slots formed said through said inwardly foldable lower portion of said sleeve material that are arranged, sized and configured to cooperatively retainably engage said first set of fasteners.

17. The kit as recited in claim 16, wherein said first set of fasteners comprise corrugated material.

18. A method of assembling a bulk material container, comprising the steps of:

(a) procuring a forming member for the container, of a type comprising a collapsible foldable plurality of connected sidewalls extending between upper and lower edges;

(b) procuring a foldable locking assembly configured to operatively engage said forming member to define and fix said sidewalls in predetermined relative positions to form and encircle an internal cavity of the container; wherein said locking assembly may comprise a part of or be pre-connected with said forming member; said locking assembly forming at least in part, a bottom surface of the cavity and including a plurality of opposed and spaced connector tabs;

(c) procuring an outer support sleeve member of continuous woven material extending between opposed open ends and having a length therebetween longer than the distance between the upper and lower edges of the forming member, said sleeve being sized and configured to snugly cooperatively engage in an overlying manner the sidewalls of the forming member, and having a plurality of circumferentially spaced vertical slots formed through the sleeve material adjacent one end thereof;

(d) cooperatively arranging said forming member and said locking assembly in connected folded configuration;

(e) sliding the outer sleeve over the cooperatively arranged folded forming member and locking assembly so as to overlie substantially the total outer surface area of the forming member sidewalls and to extend below the lower edges of the sidewalls such that said spaced slots extend below the lower edges of the sidewalls and in operative alignment with the spaced connector tabs of the locking assembly;

(f) configuring the forming member with its upper sidewall edges resting on a supporting generally planar surface such that said sidewalls enclose an internal cavity configured to receive bulk material;

(g) operatively configuring the locking assembly to fixedly lock the forming member sidewalls in operative positions relative to one another about the internal cavity;

(h) folding said one end portion of the sleeve extending beyond the lower edge of the forming member sidewalls and which includes the spaced vertical slots, inwardly over the lower sidewall edges of the forming member and toward the central cavity; and (i) securing the folded-over portion of the sleeve to the locking assembly connector tabs by sliding that portion of the sleeve material having said slots over the cooperatively aligned connector tabs until the connector tabs retainably engage the sleeve slots, in a manner that causes engaged sleeve member portions located between opposed engaged connectors to be pulled taut between the opposed spaced connector tabs; wherein said connection of the outer sleeve to the locking assembly connector tabs secures the sleeve against the locking assembly and from sliding upward along the sidewalls.

19. The method of assembling a bulk material container as recited in claim 18, wherein said step of operatively configuring the locking assembly forms sleeve retaining pockets or gaps in the locking assembly; and wherein the assembly method further includes the step of inserting excess sleeve material that has not been pulled tautly between opposed connectors tabs, into the sleeve retaining pockets or gaps.

20. The method of assembling a bulk container as recited in claim 18, wherein said procured forming member and said locking assembly are integrally formed from the same piece of foldable material; wherein said locking assembly comprises a plurality of segments extending from the bottom of said sidewalls of the forming member and are foldable relative to the forming member; and wherein said step of operatively arranging the locking assembly comprises the steps of:

(a) sequentially folding the locking assembly segments at generally right angles to said sidewalls and inwardly toward the internal cavity; and (b) cooperatively engaging at least some of the folded locking assembly segments to form a bottom surface portion of the container internal cavity.

* * * * *